US007702272B2

(12) United States Patent
Mitsuoka et al.

(10) Patent No.: US 7,702,272 B2
(45) Date of Patent: Apr. 20, 2010

(54) POWER CONTROL METHOD FOR CONTROLLING A SETTING VALUE OF ELECTRIC POWER TO BE SUPPLIED TO EACH OF COMPONENTS OF AN APPARATUS BY SWITCHING BETWEEN POWER CONTROL MODES DEPENDING ON A STATUS OF OPERATION OF EACH OF THE COMPONENTS OF THE APPARATUS

(75) Inventors: Tetsunori Mitsuoka, Tondabayashi (JP); Hiroshi Kida, Yamatokoriyama (JP); Takashi Yamanaka, Yamatokoriyama (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 822 days.

(21) Appl. No.: 10/570,303

(22) PCT Filed: Sep. 3, 2004

(86) PCT No.: PCT/JP2004/012853

§ 371 (c)(1),
(2), (4) Date: Mar. 2, 2006

(87) PCT Pub. No.: WO2005/025271

PCT Pub. Date: Mar. 17, 2005

(65) Prior Publication Data

US 2008/0131160 A1 Jun. 5, 2008

(30) Foreign Application Priority Data

Sep. 3, 2003 (JP) ..... 2003-311684

(51) Int. Cl.

*G03G 15/20* (2006.01)

(52) U.S. Cl. ..... 399/328

(58) Field of Classification Search ..... 399/328, 399/88, 69, 70

See application file for complete search history.

(56) References Cited

FOREIGN PATENT DOCUMENTS

| | | | |
|---|---|---|---|
| JP | 3-36579 | A | 2/1991 |
| JP | 8-286554 | A | 11/1996 |
| JP | 10-186940 | A | 7/1998 |
| JP | 2003-50517 | A | 2/2003 |
| JP | 2003-173107 | A | 6/2003 |
| JP | 2003-202769 | A | 7/2003 |
| JP | 2003-217793 | A | 7/2003 |
| JP | 2003-233274 | A | 8/2003 |

*Primary Examiner*—Quana M Grainger
(74) *Attorney, Agent, or Firm*—Birch, Stewart, Kolasch & Birch, LLP

(57) ABSTRACT

A control section (101) includes a first power control section (81) (a first power control mode) and a second power control section (82) (a second power control mode). The first power control section (81) is for controlling an setting value of electric power to be supplied to a heater lamp (64) based on the temperature of a heating roller (61). The second power control section (82) is for controlling the setting value of electric power to be supplied to the heater lamp (64) in order to forced-drive the heater lamp (64) by an electric power that is higher than the setting value of electric power. Switching control means (84) performs switching between the first power control mode and the second power control mode depending on a status of operation of each of components forming an image forming apparatus (100).

21 Claims, 22 Drawing Sheets

FIG.21

| | PEAK CURRENT | NOISE | VOLTAGE DROP | JUDGMENT |
|---|---|---|---|---|
| FIRST STEP | 21A | × | × | × |

| | CONDITION | FIRST STEP | SECOND STEP | PEAK CURRENT | NOISE | VOLTAGE DROP | JUDGMENT |
|---|---|---|---|---|---|---|---|
| SECOND STEP | CONDITION1 | 20% | 80% | 16A | ○ | ○ | ○ |
| | CONDITION2 | 10% | 80% | 19A | ○ | △ | △ |
| | CONDITION3 | 25% | 50% | 20A | △ | ○ | △ |
| | CONDITION4 | 10% | 50% | 20A | × | × | × |

| | CONDITION | FIRST STEP | SECOND STEP | THIRD STEP | PEAK CURRENT | NOISE | VOLTAGE DROP | JUDGMENT |
|---|---|---|---|---|---|---|---|---|
| THIRD STEP | CONDITION1 | 20% | 50% | 80% | 15.5A | ○ | ○ | ○ |
| | CONDITION2 | 5% | 30% | 85% | 19A | △ | △ | △ |
| | CONDITION3 | 40% | 70% | 90% | 19A | △ | △ | △ |
| | CONDITION4 | 5% | 75% | 95% | 20A | △ | × | × |
| | CONDITION5 | 10% | 40% | 60% | 17A | × | △ | × |
| | CONDITION6 | 10% | 25% | 85% | 19.5A | × | × | × |

○ : GOOD
△ : UNRECCOMENDABLE
× : BAD

POWER CONTROL METHOD FOR CONTROLLING A SETTING VALUE OF ELECTRIC POWER TO BE SUPPLIED TO EACH OF COMPONENTS OF AN APPARATUS BY SWITCHING BETWEEN POWER CONTROL MODES DEPENDING ON A STATUS OF OPERATION OF EACH OF THE COMPONENTS OF THE APPARATUS

TECHNICAL FIELD

This invention relates to power control method and power control device for heating means included in such an apparatus as an electric heater, a microwave oven, a dryer for a wet-type electrophotographic apparatus or ink-jet printer, and a fixing device for a dry-type electrophotographic apparatus.

BACKGROUND ART

Apparatus of the type having heating means include, for example, a fixing device for use in an image forming apparatus, such as a copying machine, configured to form an image on a medium to be heated such as a recording sheet. Such a fixing device comprises a heating roller (also referred to as a heating member) having a single or plural heating means therewithin, and a pressurizing roller (also referred to as a pressure member) in contact with the heating roller, wherein: the heating means is caused to generate heat to set the surface temperature of the heating roller to a target temperature (fixing temperature); and a medium to be heated, such as a recording sheet, bearing unfixed toner transferred thereto is passed through the contact region (fixing nip area) defined between the heating roller and the pressurizing roller with its unfixed toner bearing side facing the heating roller, whereby the unfixed toner is fixed under heat and pressure.

A control section, which is configured to control the operation of the image forming apparatus, controls an setting value of electric power to be supplied to cause the heating means to generate heat based on the surface temperature of the heating roller detected by temperature detection means.

Also, components forming the image forming apparatus, including a document reading section and a driver section, need be supplied with power. Since the image forming apparatus is supplied with a constant power from a commercial power source, the power to be supplied to each of the components of the image forming apparatus depending on the status of operation of each component for the image forming apparatus to operate properly is limited to an allowable power value that is lower than a rated power value. For this reason, the aforementioned setting value of electric power to be supplied to the heating means provided inside the heating roller is adjusted within a range not exceeding the allowable power value based on the surface temperature of the heating roller.

Recent image forming apparatus include one which is provided with power control means configured such that when the document reading section provided is in operation, the exposure lamp of the document reading section and the lamp in the heating roller of the fixing device form a series circuit to allow current to pass these lamps, while, when the document reading section is out of operation, the exposure lamp and the lamp in the heating roller form a parallel circuit to allow current to pass through the lamp in the heating roller but cut off passage of current through the exposure lamp (see patent document 1 for example). The art of patent document 1 is also configured such that, when the driving device of the image forming apparatus is out of operation, the series circuit is released to form a parallel circuit and the amounts of powers to be supplied to the exposure lamp and the heating roller lamp are increased.

Patent document 1: Japanese Patent Laid-Open Publication No. HEI 8-286554

DISCLOSURE OF INVENTION

Problems to be Solved by Invention

With the aforementioned arrangement for supplying a power not more than the allowable power value to the heating means, however, it is possible that a power sufficient to heat the surface of the heating roller is not necessarily constantly supplied to the heating means and, hence, it is possible that the fixing performance lowers due to insufficient heating of the surface of the heating roller. If the heating means is supplied with a power of an setting value more than the allowable power value, shortage of power occurs in other components, which may result in the image forming apparatus functioning improperly.

Also, with the aforementioned arrangement of patent literature 1, thought the amount of power supplied to the lamp of the heating roller is increased when the document reading device or the driving device is out of operation, there is a possibility in other situations that a power sufficient to heat the surface of the heating roller is not necessarily constantly supplied to the heating means.

Though the power to be supplied from a commercial power source can be increased, only a very limited number of offices and homes are adapted to a commercial power source capable of supplying power of such a high value. A further cost will be incurred if such an office or home is made adapted to a commercial power source of such a high power value.

An object of the present invention is to provide a power control method and power control device for maintaining the performance in heating the medium to be heated by supplying a power to the heating means as necessary as possible without limitation to the allowable power value, as well as a fixing device provided with the power control device.

Means for Solving the Problems

The present invention includes the following arrangements in order to solve the foregoing problems.

(1) A power control method for controlling a setting value of electric power to be supplied to each of components of an apparatus including a single or plural heating means for heating a medium to be heated via a heating object to a value not more than an allowable power value, characterized by switching between a first power control mode for controlling the setting value of electric power to be supplied to all the heating means based on the temperature of the heating object and a second power control mode for forced-driving at least one of the heating means by an electric power more than that the setting value of electric power, depending on a status of operation of each of the components of the apparatus.

With this arrangement, switching is performed between the first power control mode for controlling the setting value of electric power to be supplied to the heating means to a value not more than the allowable power value based on the temperature of the heating object and the second power control mode for forced-driving at least one of the heating means by an electric power that is higher than the setting value of electric power, depending on the status of operation of each of the components of the apparatus.

Accordingly, in cases where the apparatus is supplied with electric power in excess due to a decrease in the power consumption of the components while the heating means needs to be supplied with a power exceeding an allowable power value that can be outputted in the first power control mode, switching to the second power control mode is performed to forced-drive the heating means so that the heating means is additionally supplied with the excess of power, whereby a shortage in the power required for the heating means can be compensated for. For this reason, the performance in heating the medium to be heated via the heating object can be prevented from lowering.

(2) The above-mentioned forced driving is burst driving.

This arrangement performs burst driving in which the heating means is supplied with power for a fixed period of time at predetermined time intervals in the second power control mode. Since rush voltage is generated every time the heating means is supplied with power at predetermined time intervals, a mean value of power that is actually supplied to the heating means becomes higher than the setting value of electric power. Accordingly, in cases where the apparatus is supplied with electric power without excess due to the components requiring and consuming a large amount of power, even when the setting value of electric power in the second power control mode is set equal to the allowable power value that can be outputted in the first power control mode, the power actually supplied to the heating means is becomes higher than the setting value of electric power by virtue of rush voltage, whereby a shortage in the power required for the heating means can be compensated for. For this reason, the performance in heating the medium to be heated via the heating object can be prevented from lowering.

(3) The setting value of electric power to be supplied to the single or plural heating means during the burst driving is controlled depending on the status of operation of each of the components of the apparatus.

With this arrangement, the setting value of power to be supplied to the heating means during the burst driving is controlled depending on the status of operation of each of the components of the apparatus. For this reason, each component fails to experience a shortage in the power required therefor, so that the heating means is burst-driven with the function of each component maintained.

(4) The switching between the first power control mode and the second power control mode is synchronously performed with a second control cycle of the second power control mode which is longer than a first control cycle of the first power control mode; and the single or plural heating means are subjected to forced driving during the second power control mode by being supplied with electric power for a predetermined duration per one second control cycle.

With this arrangement, the second control cycle of the second power control mode in which the forced driving is performed is set longer than the first control cycle of the first power control mode in which the setting value of electric power is controlled based on the temperature of the heating object, and the switching between the first power control mode and the second power control mode is synchronously performed with the second control cycle of the second power control mode. Also, the heating means is subjected to forced driving in a manner timed to the second control cycle during the second power control mode.

Since the switching between the power control modes is synchronously performed with the second control cycle which is longer than the first control cycle, it is not possible that the second power control mode starts and stops halfway through the second control cycle and, therefore, there is no possibility that power control is performed incompletely. For this reason, the forced driving starts and stops with proper timing. Also, since the first control cycle is shorter than the second control cycle, even when the power control mode is switched to the first power control mode halfway through the first control cycle, the next cycle starts immediately thereafter to allow the power control to be performed properly.

(5) The second control cycle is an integer times as long as the first control cycle; and an updating cycle for updating value of temperature of the heating object used during the first power control mode is an integer times as long as the first control cycle for the single or plural heating means.

With this arrangement, the second control cycle and the updating cycle for updating the value of temperature of the heating object are each an integer times as long as the first control cycle. Accordingly, the first power control mode, second power control mode and update of the value of temperature of the heating object synchronize to each other and, hence, their respective execution timings will never be off. For this reason, the switching between the first power control mode and the second power control mode is not effected halfway through the cycle by virtue of their respective control cycles synchronizing to each other. Thus, each control mode is caused to work with more proper timing. Also, since the updating cycle for updating the value of temperature is synchronous with the first control cycle, an updated value of temperature is used even in controlling the setting value of electric power based on the temperature of the heating object in the first power control mode.

Further, the number of timer means for controlling the cycles is reduced since these cycles synchronize to each other. For this reason, the arrangement of such timer means becomes compact, which makes it possible to reduce the cost.

(6) Within a time period of one updating cycle for updating the value, the control modes for respective of the plural heating means start with different timings.

With this arrangement, first power control mode start timings and second power control mode start timings for respective of the plural heating means are staggered within the time period of one updating cycle for updating the value. Since the plural heating means are different from each other in control start timing for each power control mode, the plural heating means fail to start being controlled at the same time. Accordingly, large power fluctuations and increase in noise, which would otherwise occur if the plural heating means start being controlled at the same time, can be reduced, whereby the occurrence of shortage in the power required for forced driving in the second power control mode can be suppressed.

(7) The different control mode start timings for respective of the plural heating means occur within a time period of one first control cycle.

With this arrangement, first power control mode start timings and second power control mode start timings for respective of the plural heating means are staggered within the time period of one updating cycle for updating the temperature of the heating object and within the time period of one first control cycle. The second control cycle and the updating cycle for updating the temperature of the heating object are each an integer times as long as the first control cycle, while the first control cycle is the shortest of the first and second control cycles and the updating cycle for updating the temperature of the heating object. Accordingly, the control start timings for respective of the plural heating means fail to coincide with each other even if the plural heating means are operated in different control modes because the first power control mode, second power control mode and update of the value of temperature of the heating object synchronize to each other.

(8) Supply of electric power to at least one of the plural heating means in the second power control mode is inhibited from start of power supply until a predetermined inhibited time has passed within each second control cycle.

With this arrangement, supply of electric power to at least one of the plural heating means in the second power control mode is inhibited for the predetermined inhibited time from the start of the predetermined duration during which normally the power supply would be performed in the second power control mode. Accordingly, power supply start timings for the plural heating means in the second power control mode occur at an increased time interval.

(9) Supply of electric power to at least one of the plural heating means is inhibited from start of the second power control mode until the value of temperature of the heating object is updated one to three times depending on the predetermined duration.

With this arrangement, for at least one of the plural heating means the number of times of update of the value of temperature of the heating object is selected from one to three depending on the predetermined duration in the second power control mode; and supply of electric power to the at least one of the plural heating means is inhibited from the start of the predetermined duration during which normally the power supply would be performed in the second power control mode until the value of temperature of the heating object is updated the selected times. Accordingly, power supply start timings for the plural heating means in the second power control mode occur at an increased time interval.

The number of times of update is limited to one to three because, though the time required for updating the temperature of the heating object is shorter than the predetermined duration in the second power control mode, the duration of power supply in the second power control mode is extremely shortened actually unless the number of times of update is limited to one to three, thus resulting in the second power control mode exercising no effect.

(10) A value of electric power to be supplied to the plural heating means is increased gradually to the setting value of electric power in plural steps during a time period from a start of power supply in the second power control mode to a subsequent start of power supply in the second power control mode.

With this arrangement, the power of the setting value is not supplied to the plural heating means in the second power control mode immediately after the start of power supply. The value of electric power to be supplied to a first heating means is increased in plural steps during a period of time from the start of power supply to the first heating means until the start of power supply to another heating means and reaches the setting value of electric power finally.

(11) The plural steps include a first step of supplying each of the plural heating means with electric power of a value as large as 15 to 30% of the setting value of electric power and a second step of supplying each of the plural heating means with an electric power of a value as large as 65 to 85% of the setting value of electric power.

With this arrangement, during the period of time from the start of power supply to a first one of the plural heating means until the start of power supply to another heating means in the second power control mode, the value of electric power to be supplied to the first heating means is as large as 15 to 30% of the setting value of electric power in the first step and as large as 65 to 85% of the setting value of electric power in the second step and then reaches the setting value of electric power value finally.

(12) The plural steps include a first step of supplying each of the plural heating means with electric power of a value as large as 10 to 25% of the setting value of electric power, a second step of supplying each of the plural heating means with electric power of a value as large as 40 to 65% of the setting value of electric power, and a third step of supplying each of the plural heating means with electric power of a value as large as 70 to 90% of the setting value of electric power.

With this arrangement, during the period of time from the start of power supply to a first one of the plural heating means until the start of power supply to another heating means in the second power control mode, the value of electric power to be supplied to the first heating means is as large as 10 to 25% of the setting value of electric power in the first step, as large as 40 to 65% of the setting value of electric power in the second step, and as large as 70 to 90% of the setting value of electric power in the third step, and then reaches the setting value of electric power finally.

(13) The second control cycle and the predetermined duration are controlled based on the setting value of electric power upon start of the second power control mode.

With this arrangement, when the power control mode is switched to the second power control mode, the second control cycle and the predetermined duration per one second control cycle are controlled based on the setting value of electric power to be supplied for forced driving of the heating means. Accordingly, the number of times of forced driving of the heating means and the duration of each supply of power to the heating means are varied by varying the second control cycle and the predetermined duration per one second control cycle and, hence, a mean electric power actually supplied to the heating means is varied. Thus, if the second control cycle and the predetermined duration are controlled so as to maximize the mean electric power actually supplied to the heating means, a shortage in the power required for the heating means can be compensated for. For this reason, the performance in heating the medium to be heated via the heating object can be prevented from lowering.

(14) Before switching between the first power control mode and the second power control mode, judgment is made as to whether or not to perform switching to the second power control mode based on conditions of variation in the temperature of the heating object or processing conditions for heating the medium to be heated.

With this arrangement, judgment is made as to whether or not to perform switching to the second power control mode based on the conditions of variation in the temperature of the heating object including a rate of change in the surface temperature of the heating object or the processing conditions for heating the medium to be heated including the size of the medium to be heated. Accordingly, when switching to the second power control mode is not necessary, the switching to the second power control mode is inhibited and the setting value of electric power for the heating means is controlled in the first power control mode only. For this reason, it is possible to avoid an excessive rise in the surface temperature of the heating object, hence, reduce wasteful power consumption.

(15) The predetermined duration is controlled based on the conditions of variation in the temperature of the heating object or the processing conditions for heating the medium to be heated in forced-driving the single or plural heating means in the second power control mode.

With this arrangement, the predetermined duration per one second control cycle is controlled based on the conditions of variation in the temperature of the heating object including a rate of change in the surface temperature of the heating object or the processing conditions for heating the medium to be heated including the size of the medium to be heated. Accordingly, the power actually supplied to the heating means is controlled by controlling the predetermined duration per one second control cycle based on the conditions of variation in the temperature of the heating object or the processing conditions for heating the medium to be heated. Since the power actually supplied to the heating means fails to become much larger than required, it is possible to avoid an excessive rise in the surface temperature of the heating object, hence, reduce wasteful power consumption.

(16) A heating means to be switched to the second power control mode is selected from the plural heating means based on conditions of variation in the temperature of the heating object or the processing conditions for heating the medium to be heated.

With this arrangement, a heating means to be controlled in the second power control mode is selected from the plural heating means based on the conditions of variation in the temperature of the heating object including a rate of change in the surface temperature of the heating object or the processing conditions for heating the medium to be heated including the size of the medium to be heated. Since which of the heating means to be switched to the second power control mode is selected based on the conditions of variation in the temperature of the heating object including a rate of change in the surface temperature of the heating object or the processing conditions required in heating the medium to be heated including the size of the medium to be heated, not an inappropriate one but an appropriate one of the heating means is forced-driven, whereby the performance in heating the medium to be heated via the heating object can be prevented from lowering.

(17) A determination to inhibit switching to the second power control mode as a result of the judgment as to whether or not to perform switching to the second power control mode is disabled from start of heating of the medium to be heated by the heating object until a fixed time period has passed or until the number of to-be-heated bodies having been heated exceeds a predetermined number.

With this arrangement, a determination to inhibit switching to the second power control mode is disabled from start of heating of the medium to be heated by the heating object until the fixed time period has passed or the number of to-be-heated bodies having been heated-exceeds the predetermined number. Accordingly, the switching between the first power control mode and the second power control mode is not interrupted until the aforementioned disablement of the determination is cancelled. Thus, the switching to the second power control mode is prevented from being inhibited during the initial stage of heating of the medium to be heated during which the surface temperature of the heating object is unstable. For this reason, the surface temperature of the heating object can be properly maintained by switching between the first power control mode and the second power control mode.

(18) In switching to the second power control mode, at least that heating means of the plural heating means which has the highest rated power value is not to be switched to the second power control mode.

With this arrangement, at least that heating means of the plural heating means which has the highest rated power value is not switched to the second power control mode. For this reason, it is possible to suppress power consumption in the second power control mode, hence, to reduce the occurrence of shortage in the power required for forced driving in the second power control mode.

(19) The setting value of electric power to be supplied to the single or plural heating means during the first power control mode is selected from a first setting power value group consisting of plural predetermined setting power values for use in controlling the setting value of electric power in the first power control mode; and the setting value of electric power to be supplied to the single or plural heating means during the second power control mode is selected from a second setting power value group consisting of plural predetermined setting power values for use in controlling the setting value of electric power in the second power control mode.

With this arrangement, the setting value of electric power in the first power control mode is selected from the first setting power value group consisting of the plural predetermined setting power values; and the setting value of electric power in the second power control mode is selected from the second setting power value group consisting of the plural predetermined setting power values. Since the setting values of electric power in respective of the first and second power control modes are selected from respective of the predetermined first and second setting power value groups, control over the setting values of electric power is not complicated and, hence, the processing time required for determining the setting values of electric power can be shortened.

(20) Assuming that: the setting value of electric power to be supplied to an ';m'th (m=1, 2, . . . , n) one of n (n≧1) heating means in the first power control mode is W1*m* (W); the setting value of electric power to be supplied to the 'm'th heating means in the second power control mode is W2*m* (W); a second control cycle of the second power control mode is T1 (ms); a duration for which the 'm'th heating means is to be supplied with electric power within one second control cycle is T2*m* (ins); a coefficient associated with switching of the 'm'th heating means between the first power control mode and the second power control mode is K1*m*; and an increase in electric power resulting from the switching of the 'm'th heating means between the control modes is ΔWm (W), W1*m*, W2*m*, T1, T2*m*, K1*m* and ΔWm satisfy the expression of relation:

$$\Delta Wm=(1/T1)\times\{(T1\times K1m-1)\times W1m+(W2m-W1m)\times T2m\times K1m\}.$$

With this arrangement, the predetermined duration T2*m* (ms) for which the heating means is to be supplied with electric power within one second control cycle in the second power control mode can be determined from the increase ΔWm (W) in the electric power required for the heating means in the second power control mode relative to that required in the first power control mode. Thus, the predetermined duration T2*m* (ms) can be determined easily.

(21) The setting value of electric power to be supplied to at least one of the plural heating means in the second power control mode is a rated power value.

With this arrangement, the setting value of electric power to be supplied to at least one of the plural heating means in the second power control mode is adjusted to the rated power value. Accordingly, if the setting value of electric power to be supplied to a heating means of a high rated power value in the second power control mode is adjusted to the rated power value, the heating means generates a large amount of heat, so that the surface temperature of the heating object rises more rapidly.

(22) A power control device included in a main apparatus for controlling a setting value of electric power to be supplied to each of components of the main apparatus including a single or plural heating means for heating a medium to be heated via a heating object to a value not more than an allowable power value, characterized by comprising:

switching control means configured to perform switching between a first power control mode for controlling the setting value of electric power to be supplied to all the heating means based on the temperature of the heating object and a second power control mode for forced-driving at least one of the heating means by an electric power that is higher than the setting value of electric power, depending on a status of operation of each of the components of the main apparatus.

With this arrangement, the switching control means performs switching between the first power control mode for controlling the setting value of electric power to be supplied to the heating means to a value not more than the allowable power value based on the temperature of the heating object and the second power control mode for forced-driving at least one of the heating means by an electric power that is higher than the setting value of electric power depending on the status of operation of each of the components of the main apparatus.

Accordingly, in cases where the apparatus is supplied with electric power in excess due to a decrease in the power consumption of the components while the heating means need be supplied with a power exceeding the allowable power value that can be outputted in the first power control mode, the mode is switched to the second power control mode to perform forced driving so that the heating means is additionally supplied with the excess of power, whereby a shortage in the power required for the heating means can be compensated for. Thus, the performance in heating the medium to be heated via the heating object can be prevented from lowering.

(23) A fixing device included in an image forming apparatus and having a heating member to be heated by a single or plural heating means based on a detected temperature detected by temperature detection means and a pressure member positioned to press against a surface of the heating member, wherein during a printing operation of the image forming apparatus that follows completion of a warm-up operation caused by the detected temperature of the heating member reaching a temperature not lower than a target temperature, a medium to be heated is heated by being passed through a nip area defined between the heating member having the heating means therewithin and the pressure member, characterized by comprising:

a power control device as recited in the item (22) for use in controlling an setting value of electric power to be supplied to the heating means incorporated in the heating member.

With this arrangement, the fixing device used in the image forming apparatus is provided with the power control device recited in the item (22) and the power control device controls the setting value of power to be supplied to the heating means for heating the heating member based on the detected temperature of the heating member detected by the temperature detection means. Thus, the switching control means performs switching between the first power control mode for controlling the setting value of electric power to be supplied to the heating means to a value not more than the allowable power value based on the detected temperature of the heating member and the second power control mode for forced-driving at least one of the heating means for heating the heating member by an electric power that is higher than the setting value of electric power, depending on the status of operation of each of the components of the image forming apparatus.

Accordingly, in cases where the image forming apparatus is supplied with electric power in excess due to a decrease in the power consumption of the components while the heating means need be supplied with a power exceeding the setting value of electric power for the first power control mode, the mode is switched to the second power control mode to perform forced driving so that the heating means is additionally supplied with the excess of power, whereby a shortage in the power required for the heating means can be compensated for. Thus, the performance in heating the medium to be heated via the heating member can be prevented from lowering.

Further, since the mode can be switched to the second power control mode even during the warm-up operation, a shortage in the power required for the heating means can be compensated for to allow the heating member to be heated more rapidly, so that the detected temperature of the heating member reaches the target temperature quickly. Thus, the warm-up time can be shortened. Furthermore, since heat transfers from the surface of the heating member to the surface of the pressure member, the temperature of the pressure member rises quickly in the warm-up operation.

(24) The fixing device is provided with a transmission member in contact with a surface of the pressure member, the transmission member including a single or plural heating means for heating a surface of the transmission member, and temperature detection means for detecting the temperature of the transmission member, wherein the power control device is used to control the setting value of electric power to be supplied to the heating means included in the transmission member.

With this arrangement, the setting value of power to be supplied to the heating means for heating the transmission member is controlled based on the temperature of the transmission member in the first power control mode, while the setting value of electric power to be supplied to the heating means for heating the transmission member to forced-drive the heating means is controlled in the second power control mode. Also, the switching control means performs switching between the first power control mode and the second power control mode. Since the transmission member is in contact with the surface of the pressure member, the surface of the pressure member is heated properly, so that the medium to be heated is heated sufficiently by the pressure member also. Thus, the performance in heating the medium to be heated can be prevented from lowering.

Further, since the mode can be switched to the second power control mode even during the warm-up operation while heat is given to the surface of the pressure member from the surface of the transmission member, the temperature of the pressure member rises quickly even during the warm-up operation.

(25) The fixing device is provided with temperature detection means for detecting the temperature of the pressure member, wherein the switching control means judges whether or not to perform switching of the single or plural heating means for heating the transmission member to the second power control mode based on the detected temperature of the pressure member detected by the temperature detection means.

With this arrangement, the switching control means for controlling the setting value of electric power to be supplied to the heating means for heating the transmission member judges whether or not to perform switching of the heating means to the second power control mode based on the temperature of the pressure member. Since the transmission member heats the pressure member to maintain the temperature thereof properly, judgment can be made correctly as to whether or not to perform switching of the heating means for heating the transmission member to the second power control mode. Accordingly, when switching to the second power control mode is not necessary, the switching to the second power control mode is inhibited and the setting value of electric power to be supplied to the heating means included in the transmission member is controlled in the first power control mode only. For this reason, it is possible to avoid an excessive rise in the surface temperature of the heating object, hence, reduce wasteful power consumption.

(26) In the first power control mode the temperature of the pressure member is estimated from the temperature of the transmission member detected by the temperature detection means and the judgment as to whether or not to perform switching of the single or plural heating means for heating the transmission member to the second power control mode is made based on the estimated temperature of the pressure member.

With this arrangement, the judgment as to whether or not to perform switching of the heating means for heating the transmission member to the second power control mode is made based on the estimated temperature of the pressure member estimated from the temperature of the transmission member detected by the temperature detection means in the first power control mode. Therefore, the judgment can be made correctly as to whether or not to perform switching of the heating means for heating the transmission member configured to heat the surface of the pressure member to the second power control mode based on the estimated temperature of the pressure member, without provision of additional temperature detection means. Accordingly, when the switching to the second power control mode is not necessary, the switching to the second power control mode is inhibited and the setting value of electric power to be supplied to the heating means included in the transmission member is controlled in the first power control mode only. For this reason, it is possible to avoid an excessive rise in the surface temperature of the pressure member, hence, reduce wasteful power consumption.

Since there is no need to provide additional temperature detection means for detecting the temperature of the pressure member, an increase in cost can be suppressed.

(27) The switching control means causes the second power control mode to work from start of the printing operation immediately following the completion of the warm-up operation until a predetermined forced-driving time has passed.

With this arrangement, in performing the printing operation immediately after the completion of the warm-up operation in response to the detected temperature of the heating member reaching to a temperature higher than the target temperature during the warm-up operation, the second power control mode is forced to work from the start of the printing operation until the predetermined forced-driving time has passed. Since the pressure member has a larger heat capacity than the heating member, the temperature of the pressure member does not yet reach a predetermined temperature when the temperature of the heating member reaches the target temperature. In addition, the medium to be heated deprives the pressure member of heat when the printing operation starts. For this reason, the temperature of the pressure member is difficult to rise immediately after the completion of the warm-up operation. If the switching to the second power control mode is performed immediately after the completion of the warm-up operation, heat transfers to the surface of the pressure member through the nip area. In the case where the transmission member is provided, the control mode for the heating means included in the transmission member is also switched to the second power control mode to heat the pressure member.

Thus, the temperature of the pressure member is raised quickly and maintained properly even when the printing operation starts immediately after the completion of the warm-up operation. For this reason, the medium to be heated is sufficiently heated by the heating member as well as the pressure member, whereby the performance in heating the medium to be heated can be prevented from lowering.

(28) The single or plural heating means are subjected to forced driving during the second power control mode by being supplied with electric power for a predetermined duration per one second control cycle of the second power control mode, the second control cycle and the predetermined duration are varied and the second power control mode is caused to work before or immediately after passing of the predetermined forced-driving time as long as the detected temperature of the heating means is lower than a predetermined setting temperature which is lower than the target temperature.

With this arrangement, the second power control mode works while repeatedly varying the current second control cycle and the current predetermined duration to new ones until the detected temperature of the heating means reaches the predetermined setting temperature or higher either during the operation in the second power control mode that is forced to work from the start of the printing operation immediately following the completion of the warm-up operation which precedes passing of the predetermined forced-driving time or while the detected temperature of the heating means remains below the predetermined setting temperature at the time immediately after passing of the predetermined forced-driving time.

The detected temperature of the heating means remains below the predetermined setting temperature as described above because in spite of the forced driving of the heating means for heating the heating member in the second power control mode, the temperature control over the heating means does not work properly and, hence, the heating member is not sufficiently heated due to heat transfer to the medium to be heated and the like during the printing operation, heat dissipation, changes in the ambient conditions, or like factors which are much more intense than originally estimated.

Thus, the heating means for heating the heating member is supplied with a higher power than the power supplied in the currently working second power control mode to bring the detected temperature of the heating means close to the target temperature gradually. To this end, the second power control mode is caused to work with the current second control cycle and predetermined duration varied. For this reason, it is possible to improve a situation in which the forced switching to the second power control mode cannot accommodate changes in the ambient conditions or like factors which are much more intense than originally estimated, hence, prevent the performance in heating the medium to be heated via the heating member from lowering.

(29) Assuming that: a rated power value of the single heating means or a total rated power value which is the sum total of rated power values of the plural heating means is W0 (W); the setting value of electric power of the single heating means or a total setting value of electric power which is the sum total of setting values of electric power of the plural heating means is W1 (W); a rated power value of the image forming apparatus is W2 (W); a driving power value of a control section controlling an operation of the image forming apparatus is W3 (W); a value of driving power to be used in driving a mechanical portion of the image forming apparatus is W4 (W); and a rated power value of an optional part to be disposed on the image forming apparatus is W5 (W), W0, W1, W2, W3, W4 and W5 satisfy the expressions of relation:

$$W1 \leqq W2-(W3+W4+W5); \text{ and}$$

$$W1 \leqq W0.$$

With this arrangement, the setting value of electric power W1 of the heating means is a value obtained by subtracting the driving power values W3 and W4 of respective of the control section and the mechanical portion as components forming the image forming apparatus and the rated power value W5 of the optional part from the rated power value W2 of the image forming apparatus. At the same time, W1≦W0 because the rated power value W0 is desirably made higher than the setting value of electric power W1 in order to enhance the heating effect in the second power control mode. Thus, the rated power value of the heating means can be easily determined from the above-noted expressions of relation, which makes it easy to select suitable heating means to incorporated in the fixing device.

(30) The target temperature is corrected in the second power control mode for a time period of printing on a predetermined number of recording sheets or a predetermined correction time from start of the printing operation.

With this arrangement, the target temperature of the heating means is varied in the second power control mode for the time period of printing on the predetermined number of recording sheets or the predetermined correction time from the start of the printing operation. Thus, if the target temperature is varied to a higher temperature than usual, the power to be supplied to the heating means is caused to increase due to an increase in the setting value of electric power or the predetermined power supply duration or like factors.

Here, the target temperature is varied for the time period of printing on the predetermined number of recording sheets or the predetermined correction time from the start of the printing operation because it is desired to allow the surface temperature of the heating means to reach the target temperature and stabilize as quickly as possible and because it is difficult to supply an increased power to the heating means with the target temperature kept raised for a long time.

ADVANTAGES OF INVENTION

The present invention can enjoy the following advantages.

(1) By virtue of the arrangement capable of switching between the first and second power control modes for controlling the setting value of electric power of the heating means depending on the status of operation of each of the components of the apparatus, in cases where the apparatus is supplied with electric power in excess due to a decrease in the power consumption of the components while the heating means need be supplied with a power exceeding the allowable power value, the mode is switched to the second power control mode to perform forced driving so that the heating means is additionally supplied with the excess of power, whereby a shortage in the power required for the heating means can be compensated for. Thus, the performance in heating the medium to be heated via the heating object can be prevented from lowering.

(2) By supplying the heating means with power at predetermined time intervals to burst-drive the heating means, rush voltage is generated every time the heating means is supplied with power. This allows a mean value of power that is actually supplied to the heating means to become higher than the setting value of electric power. Thus, in cases where the apparatus is supplied with electric power without excess due to the a high power consumption of the components, even when the setting value of electric power in the second power control mode is set equal to the allowable power value that can be outputted in the first power control mode, the power actually supplied to the heating means is made higher than the setting value of electric power, whereby a shortage in the power required for the heating means can be compensated for. Thus, the performance in heating the medium to be heated via the heating object can be prevented from lowering.

(3) By controlling the setting value of power to be supplied to the heating means for burst driving depending on the status of operation of each of the components of the apparatus, each component can be prevented from experiencing a shortage in the power required therefor, whereby the heating means can be properly burst-driven with the function of each component maintained.

(4) By timing the switching between the first power control mode and the second power control mode to the second control cycle, the second power control mode can be started and stopped in a manner timed to the second control cycle, thus making it possible to start and stop forced driving with proper timing.

(5) With each of the second control cycle and the updating cycle for updating the detected temperature of the heating object being an integer times as long as the first control cycle, the switching between the first power control mode and the second power control mode can be synchronously performed with the first and second control cycles, thus allowing each control mode to work with more proper timing. Also, since the updating cycle for updating the value of temperature is synchronous with the first control cycle, control over the setting value of electric power based on the temperature of the heating object in the first power control mode can be performed with precision based on an updated value of temperature.

Further, the number of timer means for controlling the cycles can be reduced since these cycles synchronize to each other. For this reason, the arrangement of such timer means can be made compact, which makes it possible to reduce the cost.

(6) By staggering first control mode start timing and second power control mode start timing for the plural heating means within the time period of one updating cycle for updating the temperature of the heating object, large power fluctuations and increase in noise, which would otherwise occur if the plural heating means start being controlled at the same time, can be reduced, whereby the occurrence of shortage in the power required for forced driving in the second power control mode can be suppressed.

(7) By staggering first power control mode start timing and second power control mode start timing for the plural heating means within the time period of one first control cycle, the control start timings for the plural heating means can be prevented from coinciding with each other more reliably. Thus, large power fluctuations and increase in noise, which would otherwise occur if the plural heating means start being controlled at the same time, can be reduced, whereby the occurrence of shortage in the power required for forced driving in the second power control mode can be suppressed.

(8) By the arrangement wherein supply of electric power to at least one of the plural heating means is inhibited from the start of the predetermined duration until the predetermined inhibited time has passed or until the value of temperature of the heating object is updated one to three times, power supply start timings for the plural heating means in the second power control mode are staggered more largely, thus making it possible to suppress the increase in the total peak power supplied to the plural heating means upon generation of rush current as well as to minimize the decrease in the effect of power supply in the second power control mode.

This arrangement is effective because, since rush current that is generated in the beginning of power supply to the heating means in the second power control mode is very large, it is possible that the arrangement configured to stagger only the second power control mode start timings within the time period of one first control cycle causes the next heating means to be undesirably burst-driven before the power supplied lowers to reach the setting value of electric power completely.

Thus, large power fluctuations and increase in noise, which would otherwise occur if the plural heating means start being controlled at the same time, can be reduced, whereby the occurrence of shortage in the power required for forced driving in the second power control mode can be suppressed.

(9) By increasing the value of electric power to be supplied to one of the plural heating means in the second power control mode to the setting value of electric power in plural steps during a period of time from the start of power supply to that heating means to the start of power supply to another heating means, the amount of rush current can be reduced as compared with the case of such forced driving as to supply power of the setting value immediately after the start of power supply, thus making it possible to reduce the total peak power supplied to the plural heating means upon generation of rush current. Thus, large power fluctuations and increase in noise, which would otherwise occur if the plural heating means start being controlled at the same time, can be reduced, whereby the occurrence of shortage in the power required for forced driving in the second power control mode can be suppressed.

(10) By the arrangement wherein during the period of time from the start of power supply to one of the plural heating means in the second power control mode until the start of power supply to another heating means, the value of electric power to be supplied to that heating means is as large as 15 to 30% of the setting value of electric power in the first step and as large as 65 to 85% of the setting value of electric power in the second step and then reaches the setting value of electric power finally, power fluctuations which occur during power supply in the first and second steps can be suppressed effectively.

(11) By the arrangement wherein during the period of time from the start of power supply to one of the plural heating means in the second power control mode until the start of power supply to another heating means, the value of electric power supplied to that heating means is as large as 10 to 25% of the setting value of electric power in the first step, as large as 40 to 65% of the setting value of electric power in the second step and as large as 70 to 90% of the setting value of electric power in the third step and then reaches the setting value of electric power finally, power fluctuations which occur during power supply in the first to third steps can be suppressed effectively.

(12) By controlling the second control cycle and the predetermined duration per one second control cycle based on the setting value of electric power to be supplied for forced driving of the heating means, the mean electric power actually supplied to the heating means can be maximized thereby compensating for a shortage in the power required for the heating means. For this reason, the performance in heating the medium to be heated via the heating object can be prevented from lowering.

(13) By judging whether or not to perform switching to the second power control mode based on conditions of variation in the temperature of the heating object or processing conditions for heating the medium to be heated, the setting value of electric power of the heating means can be controlled only in the first power control mode with the switching to the second power control mode inhibited when the switching to the second power control mode is not necessary. For this reason, it is possible to avoid an excessive rise in the surface temperature of the heating object thereby to maintain the surface temperature of the heating object properly, hence, reduce the power consumption in the second power control mode.

(14) By adjusting the predetermined duration per one second control cycle based on conditions of variation in the temperature of the heating object or processing conditions for heating the medium to be heated, the power actually supplied to the heating means can be controlled properly. For this reason, it is possible to avoid an excessive rise in the surface temperature of the heating object as well as to reduce the power consumption in the second power control mode.

(15) By selecting a heating means to be controlled in the second power control mode from the plural heating means based on conditions of variation in the temperature of the heating object or processing conditions for heating the medium to be heated, the heating means that is suitable to work in the second power control mode can be selected. For this reason, it is possible to prevent the performance in heating the medium to be heated from lowering as well as to reduce the power consumption in the second power control mode.

(16) By the arrangement wherein a determination to inhibit the switching to the second power control mode is disabled from the start of heating of the medium to be heated by the heating object until the fixed time period has passed or until the number of to-be-heated bodies having been heated exceeds a predetermined number, the switching to the second power control mode is prevented from being inhibited during the initial stage of heating of the medium to be heated during which the surface temperature of the heating object is unstable. For this reason, the surface temperature of the heating object can be properly maintained while the switching between the first power control mode and the second power control mode is performed.

(17) By the arrangement wherein at least that heating means of the plural heating means which has the highest rated power value is not to be switched to the second power control mode, it is possible to suppress power consumption in the second power control mode, hence, suppress the occurrence of shortage in the power required for forced driving in the second power control mode.

(18) By the arrangement wherein: the setting values of electric power to be supplied to the heating means in the first and second power control modes are selected from the predetermined first and second setting power value groups, control of the setting values of electric power is not complicated and, hence, the processing time required for determining the setting values of electric power can be shortened.

(19) By determining the predetermined duration T2*m* (ms) for which electric power is supplied within one second control cycle in the second power control mode based on the above-noted expression of relation, accurate duration T2*m* (ms) can be found.

(20) By adjusting the setting value of electric power to be supplied to at least one of the plural heating means in the second power control mode to the rated power value, the heating means generates a large amount of heat thereby raising the surface temperature of the heating object more rapidly if the setting value of electric power to be supplied to a heating means of a high rated power value in the second power control mode is adjusted to the rated power value.

(21) Switching between the first and second power control modes for controlling the setting value of electric power of the heating means is performed depending on the status of operation of each of the components of the apparatus. With this arrangement, in cases where the apparatus is supplied with electric power in excess due to a decrease in the power consumption of the components while the heating means need be supplied with a power exceeding the allowable power value, the mode can be switched to the second power control mode to perform forced driving so that the heating means is additionally supplied with the excess of power, whereby a shortage in the power required for the heating means can be compensated for. Thus, the performance in heating the medium to be heated via the heating object can be prevented from lowering.

(22) Switching between the first and second power control modes for controlling the setting value of electric power of the heating means for heating the heating member is performed depending on the status of operation of each of the components of the apparatus. With this arrangement, in cases where the apparatus is supplied with electric power in excess due to a decrease in the power consumption of the components while the heating means need be supplied with a power exceeding the allowable power value, the mode can be switched to the second power control mode to perform forced driving so that the heating means is additionally supplied with the excess of power, whereby a shortage in the power required for the heating means can be compensated for. Thus, the performance in heating the medium to be heated via the heating object can be prevented from lowering.

Further, since the mode can be switched to the second power control mode even during the warm-up operation, the warm-up time can be shortened significantly and, hence, the waiting time up to the completion of the warm-up operation can be shortened significantly. Furthermore, since heat is applied from the surface of the heating member to the surface of the pressure member, the temperature of the pressure member can be raised quickly in the warm-up operation.

(23) By controlling the setting value of power to be supplied to the heating means for heating the transmission member with use of the power control device, the surface of the pressure member can be heated properly. For this reason, the medium to be heated can be heated sufficiently by the pressure member also, whereby the performance in heating the medium to be heated can be prevented from lowering.

Further, since the mode can be switched to the second power control mode to apply heat to the surface of the pressure member from the surface of the transmission member even during the warm-up operation, the temperature of the pressure member can be raised quickly even during the warm-up operation.

(24) The switching control means for controlling the setting value of electric power of the heating means for heating the transmission member can correctly judge whether or not to perform switching to the second power control mode based on the surface temperature of the pressure member. Since the switching to the second power control mode can be inhibited when the switching to the second power control mode is not necessary, the setting value of electric power of the heating means included in the transmission member can be controlled in the first power control mode only. For this reason, it is possible to avoid an excessive rise in the temperature of the pressure member thereby to maintain the temperature of the pressure member properly, as well as to reduce the power consumption in the second power control mode.

(25) By the arrangement wherein the judgment as to whether or not to perform switching of the heating means for heating the transmission member to the second power control mode is made based on the surface temperature of the pressure member estimated from the temperature of the transmission member in the first power control mode, the judgment can be made more correctly as to whether or not to perform switching of the heating means for heating the transmission member to the second power control mode without provision of additional temperature detection means. Since the switching to the second power control mode can be inhibited when the switching to the second power control mode is not necessary, the setting value of electric power of the heating means for heating the transmission member can be controlled in the first power control mode only. For this reason, it is possible to avoid an excessive rise in the temperature of the pressure member thereby to maintain the temperature of the pressure member properly, as well as to reduce the power consumption in the second power control mode.

(26) By the arrangement wherein the switching to the second power control mode is forced to cause the second power control mode to work from the start of the printing operation immediately following the completion of the warm-up operation until the predetermined forced-driving time has passed, the temperature of the pressure member or that of the transmission member can be raised quickly and maintained properly even when the printing operation starts immediately after the completion of the warm-up operation. For this reason, the medium to be heated is sufficiently heated by the pressure member also, whereby the performance in heating the medium to be heated can be prevented from lowering.

(27) By the arrangement wherein the second power control mode is caused to work with the current second control cycle and the current predetermined duration varied to supply the heating means for heating the heating member with a higher power than the power supplied in the current second power control mode before or immediately after passing of the predetermined forced-driving time as long as the detected temperature of the heating means is below the predetermined setting temperature, the detected temperature of the heating means can be brought closer to the target temperature gradually. For this reason, it is possible to improve a situation in which the forced switching to the second power control mode cannot accommodate such changes in the ambient conditions as not originally presumed or like factors, hence, prevent the performance in heating the medium to be heated via the heating member from lowering.

(28) By the arrangement wherein the setting value of electric power W1 of the heating means is obtained by subtracting the driving power values W3 and W4 of respective of the control section and the mechanical portion as components forming the image forming apparatus and the rated power value W5 of the optional part from the rated power value W2 of the image forming apparatus while the rated power value W0 is made higher than the setting value of electric power W1, the rated power value of the heating means for enhancing the heating effect in the second power control mode can be easily determined from the above-noted expressions of relation. Thus, it is possible to easily select suitable heating means to be incorporated in the fixing device.

(29) By the arrangement wherein the target temperature of the heating means in the second power control mode is corrected for a time period of printing on the predetermined number of recording sheets or the predetermined correction time from the start of the printing operation, the power to be supplied to the heating means can be increased temporarily thereby making it possible to raise the surface temperature of the heating member more quickly. For this reason, the performance in heating the medium to be heated can be assured from the start of printing.

BRIEF DESCRIPTION OF DRAWINGS

FIG. 21 is a table showing the relationship between a value of current supplied in each step of slow-up control and a peak current.

DESCRIPTION OF REFERENCE CHARACTERS

Figure 1:
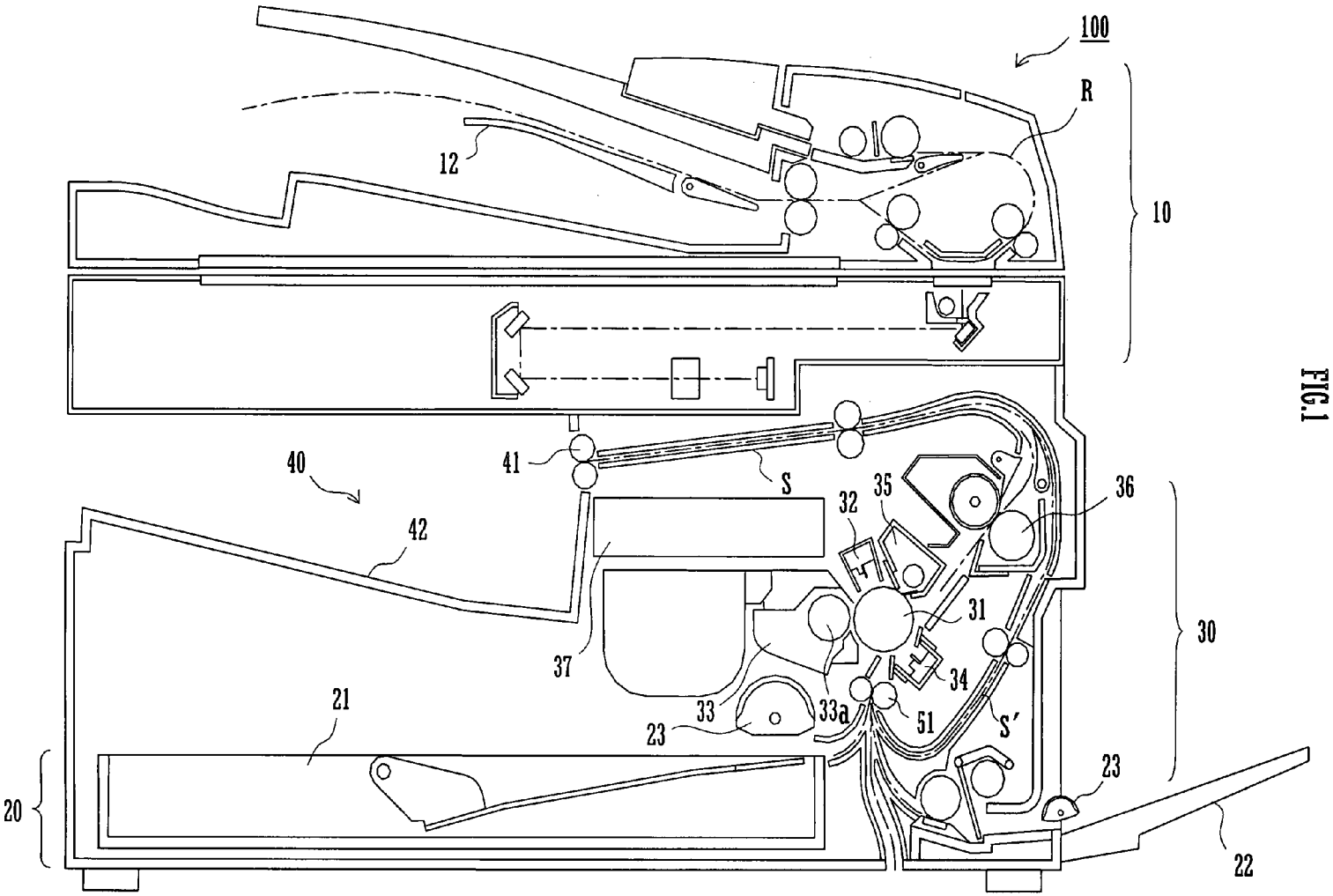
FIG. 1 is a sectional view schematically showing the construction of an image forming apparatus in which a fixing device according to an embodiment of the present invention is used.

36 . . . fixing device
61 . . . heating roller
62 . . . pressurizing roller
63 . . . external heating roller
64 . . . heater lamp
66 . . . thermistor
80 . . . power control section
81 . . . first power control section
82 . . . second power control section
83 . . . burst-driving timing control
84 . . . switching control means
84*a*-84*c* . . . switching devices
85 . . . switching condition judgment means
86 . . . surface temperature estimating means
100 . . . image forming apparatus
101 . . . control section
110 . . . pressurizing belt
111 . . . pressurizing and heating roller
115 . . . heater lamp

BEST MODE FOR CARRYING OUT THE INVENTION

FIG. 1 is a sectional view schematically showing the construction of an image forming apparatus in which a fixing device according to an embodiment of the present invention is used. An image forming apparatus 100 corresponding to the main apparatus defined by the present invention has a copier mode, printer mode and FAX mode as image forming modes for forming images on recording sheets (including recording mediums for OHP and like recording mediums), any one of which modes is to be selected by the user. The image forming apparatus 100 is capable of double-side printing.

The image forming apparatus 100 includes a document reading section 10, a sheet feeding section 20, an image forming section 30, a sheet delivery section 40, non-illustrated operating panel section and control section, and like sections. The document reading section 10, disposed in an upper portion of the apparatus body, comprises platen glass 11, a document tray 12, a scanner optical system 13, and the like. The scanner optical system 13 has a light source 14, reflection mirrors 15*a* to 15*c*, an optical lens 16, and a CCD (Charge Coupled Device) 17. The light source 14 illuminates a document placed on the platen glass 11 or under feeding on a document feed path R from the document tray 12. The plural reflection mirrors 15*a* to 15*c* guide reflected light from the document to the optical lens 16 by reflection. The optical lens 16 condenses reflected light guided by the reflection mirrors 15*a* to 15*c* and guides it to the CCD 17. The CCD 17 photoelectric-converts reflected light thus condensed.

The sheet feeding section 20, disposed in a lower portion of the apparatus body, comprises a sheet feed tray 21, a manual feed tray 22, pickup rollers 23, and the like. The sheet feed tray 21 and the manual feed tray 22 each hold thereon recording sheets to be fed to a sheet feed path S in image formation. The pickup rollers 23 each rotate to feed recording sheets held on a respective one of the trays 21 and 22 to the sheet feed path S.

The image forming section 30, disposed below the document reading section 10 on the manual feed tray 22 side, has a laser scanning unit (hereinafter will be referred to as LSU) 37, a photosensitive drum 31, and a fixing device 36. About the photosensitive drum 31 there are disposed an electrostatic charger 32, a developing device 33, a transfer device 34 and a cleaner unit 35 in this sequence along the direction of rotation of the photosensitive drum 31, which is indicated by arrow in FIG. 1.

The sheet delivery section 40, disposed above the sheet feed tray 21, comprises a sheet delivery roller 41, a delivered sheet tray 42, and the like. The sheet delivery roller 41 delivers recording sheets fed thereto on the sheet feed path S onto the delivered sheet tray 42. The sheet delivery roller 42 is rotated by a rotating force transmitted thereto from a drive motor 70 corresponding to the driving power source defined by the present invention through a pinion gear 71 and a delivery roller driving gear 72. The sheet delivery roller 41 is forwardly and backwardly rotatable. In printing images on both sides of a recording sheet, the sheet delivery roller 41 nips a recording sheet finished with image formation on an obverse side thereof that has been fed thereto on the sheet feed path S, and then rotates in the direction opposite from the direction of rotation for delivering the recording sheet to transport the recording sheet to a sheet feed path S'. Thus, the recording sheet is turned upside down, so that the reverse side thereof comes to face the photosensitive drum 31 to allow a toner image to be transferred to the reverse side. The delivered sheet tray 42 receives recording sheets finished with image formation from the sheet delivery roller 41.

The control section controls the operation of the image forming apparatus 100.

In copying a document image on a recording sheet in the copier mode, a document to be copied is placed on the platen glass 11 or the document tray 12 in the document reading section 10 and then settings including a number of copies and a printing magnification are inputted by depressing input keys on the operating panel section before the copying operation to be started by depressing a start key.

In response to the depression of the start key, the image forming apparatus 100 causes the pickup roller 23 to rotate for feeding a recording sheet to the sheet feed path S. The recording sheet thus fed is transported to a registration roller 51 located on the sheet feed path S.

The leading edge of the recording sheet reaching the registration roller 51 in the sheet feed direction is nipped by the registration roller 51 so as to be oriented parallel with the axis of the registration roller 51 for the recording sheet to be registered with a toner image formed on the photosensitive drum 31 that is to be transferred to the recording sheet.

Image data read by the document reading section 10 is subjected to image processing under the conditions inputted from the input keys and the like and then transmitted as print data to the LSU 37. The LSU 37 irradiates the surface of the photosensitive drum 31 electrostatically charged to a predetermined potential by the electrostatic charger 32 with laser light in accordance with the image data via non-illustrated polygon mirror and different lenses. Thereafter, toner adhering to the surface of an MG roller 33*a* included in the developing device 33 is attracted to the photosensitive drum 31 surface in accordance with a potential gap on the photosensitive drum 31 surface to develop an electrostatic latent image.

Thereafter, the registration roller 51 registers the recording sheet nipped thereby with the toner image formed on the photosensitive drum 31 surface and feeds it to between the photosensitive drum 31 and the transfer device 34. Subsequently, the transfer device 34 transfers the toner image from the photosensitive drum 31 surface to the recording sheet by means of a transfer roller 34*a* included therein. The recording sheet finished with transfer of the toner image is subjected to heat and pressure during passage through the fixing device 36, so that the toner image is fused and fixed to the recording sheet. Finally, the recording sheet is delivered to the delivered sheet tray 42 by means of the delivery roller 41.

Residual toner remaining on the photosensitive drum 31 is scraped off by a cleaning blade of a non-illustrated drum unit and then collected by the cleaner unit 35.

Embodiment 1

Figure 2:
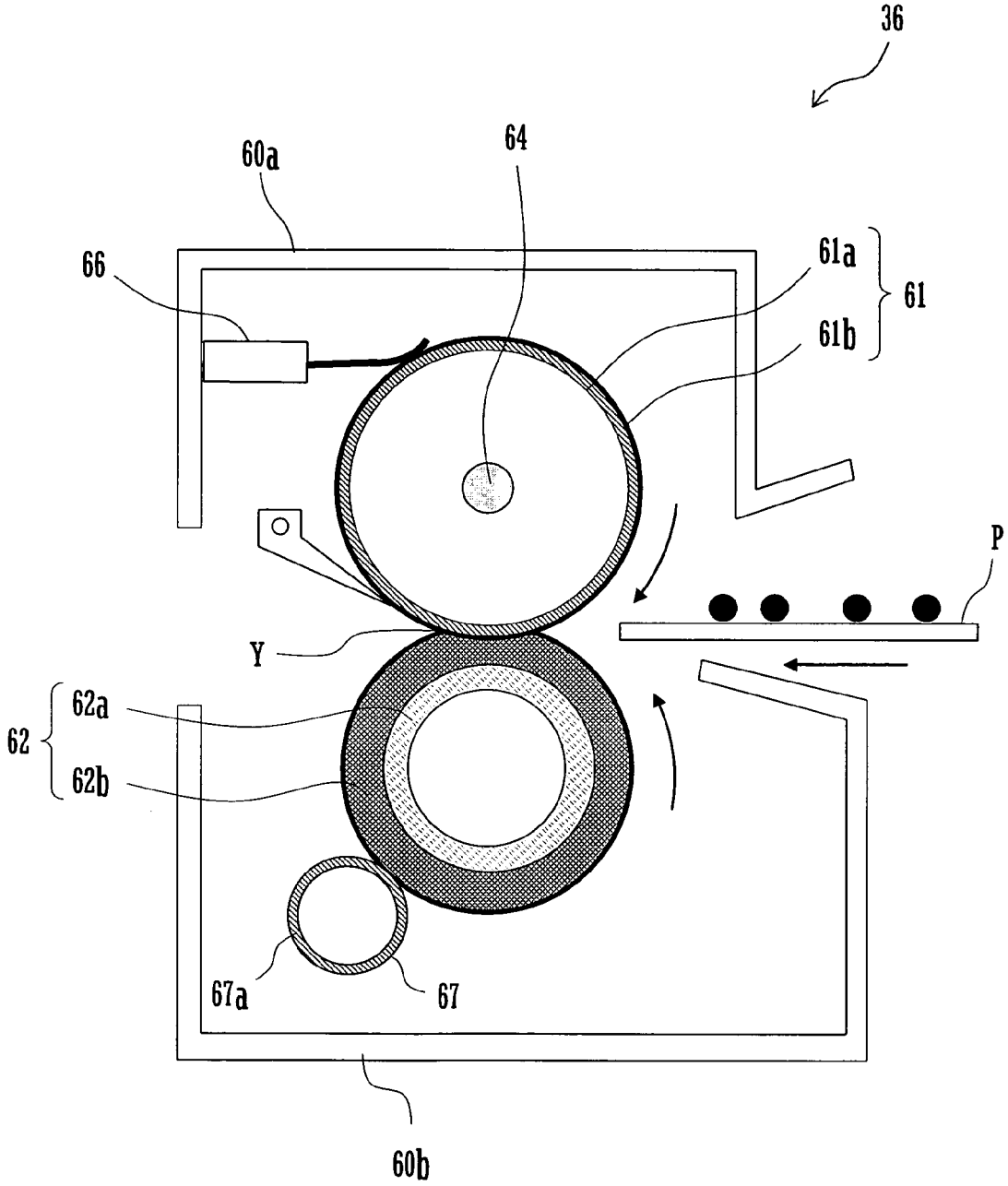
FIG. 2 is a sectional view schematically showing the construction of a fixing device according to an embodiment of the present invention.

FIG. 2 is a sectional view schematically showing the construction of a fixing device according to an embodiment of the present invention. As shown in FIG. 2, the fixing device 36 includes fixing covers 60 (including an upper fixing cover 60*a* and a lower fixing cover 60*b*), a heating roller 61, a pressurizing roller 62, a heater lamp 64, a thermistor 66, a cleaning roller 67, a power control device to be described later, and like components.

The heater lamp 64, which corresponds to the heating means defined by the present invention, is located within the heating roller 61. The heater lamp 64 comprises a halogen lamp encapsulating a halogen-type inert gas within a glass tube where a non-illustrated tungsten filament is disposed. When the filament is energized, the heater lamp 64 heats the surface of the heating roller 61 through the inner peripheral surface of the heating roller 61. The rated power value of the heater lamp 64 is 1000 W in this embodiment. The heater lamps 64 is capable of providing different heat distribution patterns by adjusting the position and size of the filament in the glass tube, the heat distribution patterns including a center-high pattern in which an axially central portion mainly generates a larger amount of heat, and an end-high pattern in which axially end portions mainly generates a larger amount of heat.

The heating roller 61, which corresponds to the heating member defined by the present invention, is rotatable clockwise and is heated to a fixed temperature (200° C. in this embodiment) at its surface by the heater lamp 64. The heating roller 61 serves to heat the side of recording sheet P to which unfixed toner has been transferred during passage of the recording sheet P through a fixing nip area to be described later. Such a recording sheet P bearing an unfixed toner image transferred thereto corresponds to the medium to be heated defined by the present invention. The heating roller 61 comprises a hollow cylindrical core 61*a* as a main body, a release layer 61*b* formed over the outer peripheral surface of the core 61*a*, and the like.

The core 61*a* comprises, for example, a metal such as iron, stainless steel, aluminum or copper, or an alloy thereof. In the present embodiment, a core of an aluminum alloy having an outer diameter of 30 mm and a wall thickness of 1.3 mm is used as the core 61*a*. Fluororesins such as PFA (tetrafluoroethylene-perfluoroalkylvinyl ether copolymer) and PTFE (polytetrafluoroethylene), silicone rubber, fluororubber, and like materials are suitable for the release layer 61*b*. In the present embodiment, the release layer 231*b* comprises a 25 μm-thick baked coat covering the outer periphery of the core 61*a*, the baked coat being formed from a blend of PFA and PTFE.

The heating roller 61 is shaped like an inverted crown so that its central portion is smaller in diameter than its end portions.

The pressurizing roller 62, which corresponds to the pressure member defined by the present invention, is rotatable counterclockwise and comprises a hollow cylindrical core 62*a* of steel, stainless steel, aluminum or the like, a heat-resistant resilient layer 62*b* of silicone rubber or the like covering the outer peripheral surface of the core 62*a*. A release layer comprising the same fluororesin as used in the heating roller 61 may be formed over the outer peripheral surface of the heat-resistant resilient layer 62*b*.

In the present embodiment, the pressurizing roller 62 comprises core 62*a* of stainless steel having an outer diameter of 14 mm, and heat-resistant resilient layer 62*b* of silicone rubber covering the outer peripheral surface of the core 62*a*. The pressurizing roller 62 has an outer diameter of 30 mm. The pressurizing roller 62 abuts against the heating roller 61 by means of a non-illustrated pressing member such as a spring thereby defining a fixing nip area Y, which corresponds to the nip area defined by the present invention. The pressurizing roller 62 presses the recording sheet P against the heating roller 61 during the passage of the recording sheet P through the fixing nip area Y.

The cleaning roller 67 serves to prevent the pressurizing roller 62 from being stained by eliminating toner, paper particles and the like adhering to the pressurizing roller 62. Specifically, the cleaning roller 67 abuts against the pressurizing roller 232 by a predetermined force on an upstream side of the heating nip area Z in the counterclockwise direction and driven to rotate with rotation of the pressurizing roller 62. The cleaning roller 67 comprises a hollow cylindrical metal core 67*a* made of aluminum, an iron material or the like. The present embodiment uses a stainless steel material for the metal core 67*a*.

The thermistor 66, which corresponds to the temperature detection means defined by the present invention, is disposed on a surface of the heating roller 61 to detect the surface temperature of the heating roller 61. In this embodiment the temperature detection means is brought into contact with the surface of the heating roller 61 to detect the surface temperature thereof. However, the temperature detection means is not limited to surface temperature detection but may be disposed inside the heating roller 61 or regardless of whether or not it is in contact with the heating roller 61.

Figure 3:
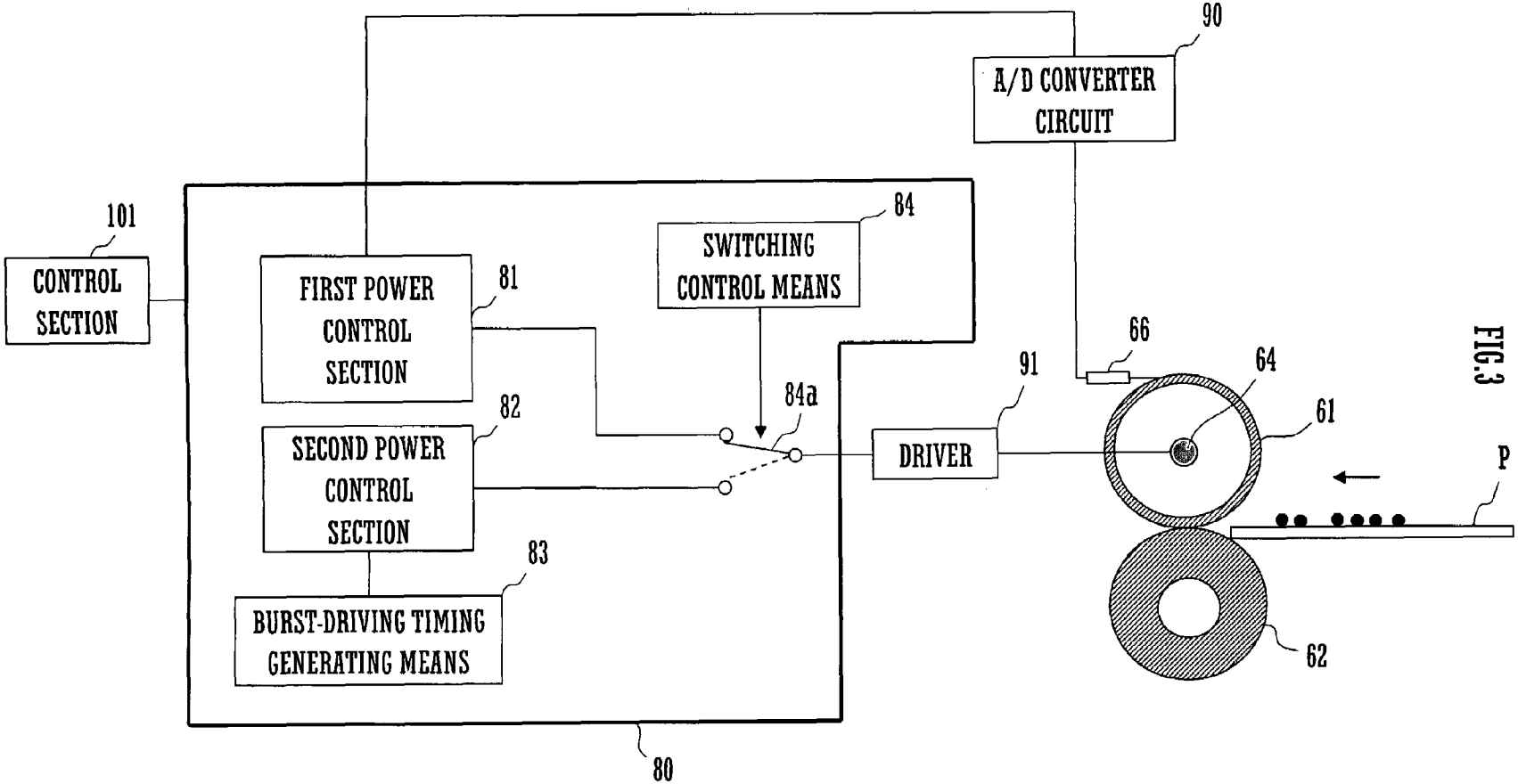
FIG. 3 is a block diagram showing the configuration of a power control section included in the fixing device.

FIG. 3 is a block diagram showing the configuration of a power control section included in a fixing device according to an embodiment of the present invention. As shown in FIG. 3, the power control section 80, which corresponds to the power control device defined by the present invention, comprises a first power control section 81, a second power control section 82, burst-driving timing generating means 83, switching control means 84 and the like and is connected to a control section 101 controlling the operation of the image forming apparatus 100. The first power control section 80 is connected to components forming the image forming apparatus 100 including the control section 101, a driver section and the like and configured to control setting values of electric power to be supplied to respective of the components including the thermistor 66. Each of the setting values of electric power is an instructed value of power to be outputted to a respective one of the components. Based on such a setting value of electric power, electric power is supplied to each component.

The first power control section 81 is connected to the thermistor 66 via an A/D converter circuit 90 as well as to the heater lamp 64 via the switching control means 84 and a driver 91. The first power control section 81 receives the value of surface temperature of the heating roller 62 outputted from the thermistor 66, controls the setting value of electric power to be supplied to the heater lamp 62 based on the received value, and causes a first power control mode to work for supplying the heater lamp 64 with a power of the setting value of electric power. Usually, the surface temperature of the heating roller 61 is held constant by means of the first power control section 81. Though the rated power value of the heater lamp 64 according to this embodiment is 1000 W, the allowable value of power which can be actually supplied to the heater lamp 64 by the first power control section 84 is limited to 700 W. This is because, since the power to be supplied from a commercial power source to the image forming apparatus 100 is usually 1500 W and other components forming the image forming apparatus 100 also need to be supplied with power, it is possible that the other components fail to work normally if the heater lamp 64 is supplied with a power of 1000 W.

The second power control section 82 is connected to the heater lamp 64 via the switching control means 84 and the driver 91 as well as to the burst-driving timing generating means 83. The second power control section 82 causes a second power control mode to work for controlling the setting value of electric power to be supplied to the heater lamp 64 based on the status of operation of each component of the image forming apparatus 100.

Further, the second power control section 82 burst-drives (forced-drives) the heater lamp 64 by supplying a power of the setting value of electric power to the heater lamp 64 for a predetermined duration based on a signal received from the burst-driving timing generating means 83. The burst-driving timing generating means 83 outputs such a signal to the second power control section 82 in synchronism with a second control cycle which is the control cycle of the second power control section 82.

The second power control section 82 burst-drives the heater lamp 64 by adjusting the setting power to a value that is not lower than the allowable power value based on the status of operation of each component of the image forming apparatus 100. That is, the second power control section 82 supplies the heater lamp 64 with a power of the setting value for the predetermined duration, the setting value being a value obtained by subtracting the powers to be used by the components from the power supplied to the image forming apparatus 100 from the commercial power source. This arrangement enables the heater lamp 64 to be burst-driven properly while preventing the occurrence of shortage in the power required for each component to maintain the function of each of the components.

It is possible that: a first setting power value group and a second setting power value group, each of which consists of plural setting power values suited to a respective one of the first and second power control modes, are previously stored in non-illustrated storage means; and an appropriate setting value is selected from the setting power value groups and read out of the storage means upon switching between the power control modes or during working of each mode. This arrangement makes it possible to shorten the processing time required in determining the appropriate setting value by avoiding complicated control of the setting power values. For example, the first and second setting power value groups suited to the warm-up operation and the different operations of the image forming apparatus including the image forming operation are previously stored in the storage means.

W1 (W) representing the setting value of electric power of a single heating lamp 64 or the total setting value of electric power which is the sum total of the setting values of electric power of plural heating lamp 64 satisfies the expression (1):

$$W1 \leqq W2-(W3+W4+W5) \quad (1)$$

wherein the rated power value of the image forming apparatus 100 is W2 (W); the driving power value of the control section controlling the operation of the image forming apparatus 100 is W3 (W); the value of driving power used in driving a mechanical portion of the image forming apparatus 100 including the document reading device and the like is W4 (W); and the rated power value of an optional part to be disposed on the image forming apparatus 100 is W5 (W). Further, W0 (W) representing the rated power value of the single heating lamp 64 or the total rated power value of the plural heating lamps 64 satisfies W1≦W0. Thus, the rated power value of the heating lamp 64 can be easily determined from the above-noted the expression (1) based on the allowable power value which is a minimum value of power that can be supplied. For this reason, selection of a suitable heating lamp 64 to be incorporated in the fixing device 36 can be made easily. For example, assuming that: the rated power value W2 of the image forming apparatus 100 is 1500 W; the driving power value W3 of the control section is 50 W; the value W4 of driving power to be used in driving the mechanical is 250 W; and the rated power value W5 of the optional part is 100 W, the heating lamp 64 can be used when the setting value of electric power is not higher than 1100 W and the rated power value of the heating lamp 64 is in the range from 1100 W to 1700 W within which a value of power to be supplied for burst driving can be setting freely (usually, power of such a value is not supplied in the first power control mode.)

Figure 4:
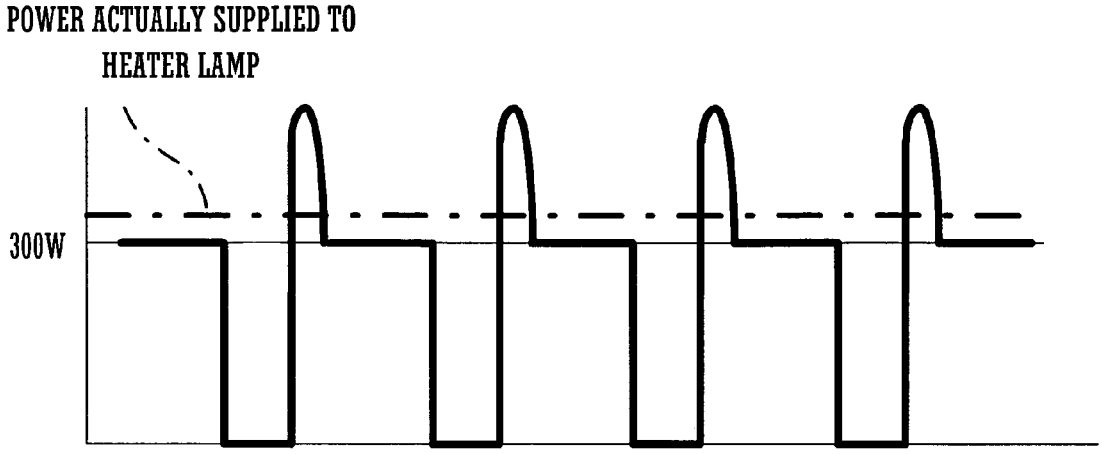
FIG. 4 is a diagram illustrating burst driving.

In the burst driving, on the other hand, the heater lamp 64 is supplied with power of the setting value of electric power for the predetermined duration within one second control cycle in response to the signal from the burst-driving timing generating means 83. Further, since the heater lamp 64 is burst-driven by being supplied with the power for the predetermined duration periodically, rush voltage is generated every time supply of power is started. For this reason, the heater lamp 64 is supplied with a power higher than the setting value of electric power on average, whereby shortage in the required power can be compensated for. As shown in FIG. 4, when the heater lamp 64 is burst-driven by a power of 300 W for example, a rush voltage corresponding to a power much higher than 300 W is generated momentarily. Accordingly, during repeated burst driving, the heater lamp 64 is supplied with a power of a mean value higher than 300 W.

An increase ΔWm (W) in electric power resulting from the switching of an 'm'th one (m=1, 2, . . . , n) of n (n≧1) heating lamps 64 from the first power control mode to the second control mode is expressed by:

$$\Delta Wm=(1/T1)\times\{(T1\times K1m-1)\times W1m+(W2m-W1m)\times T2m\times K1m\} \quad (2)$$

wherein the setting value of electric power to be supplied to the 'm'th heating lamp 64 in the first power control mode is W1*m* (W); the setting value of electric power to be supplied to the 'm'th heating lamp 64 in the second power control mode is W2*m* (W); the second control cycle is T1 (ms); the predetermined duration for which the 'm'th heating lamp 64 is to be supplied with electric power within one second control cycle in the second power control mode is T2*m* (ms); and a coefficient associated with switching of the 'm'th heating lamp 64 between the first power control mode and the second power control mode is K1*m*.

In the present embodiment, m=1 because the single heating lamp 64 is used. If the power to be actually supplied to the heater lamp 64, which is determined based the surface temperature of the heating roller 61, is 1000 W for example, the increase ΔWm in the power=1000−700=300 W because the allowable power value in the first power control mode is 700 W. Since the heater lamp 64 is supplied with a power higher than the setting value of electric power used in the first power control mode during burst driving, the setting value of electric power W11 used in the first power control mode is equal to the allowable power value. Assuming that: the setting value of electric power W21 used in the second power control mode is 900 W; the second control cycle T1 is 1500 ms; and K11 is 0.35, the following expression holds: T21={T1×ΔW1−(T1×K11−1)×W11}/{(W21−W11)×K11}. It follows that T21={1500×300−(1500×0.35−1)×700}/{(900−700)×0.35}. Thus, T21=1188.6 (ms). In this way, the predetermined duration T21 relative to the setting value of electric power W21 (=900 W) of power to be supplied to the heater lamp 64 can be accurately determined with ease.

It is possible to vary the predetermined duration T21 for which the heater lamp 64 is supplied with power of the setting value of electric power W21 and the second control cycle T1 based on the setting value of electric power W21 of 900 W. By varying the predetermined duration T21 and the second control cycle T1 based on the setting value of electric power W21, it is possible to maximize the mean value of power to be supplied to the heater lamp 64 relative to the setting value of electric power W21 thereby to compensate for a shortage in the power required for the heater lamp 64 more fully. Thus, the performance in heating recording sheet P can be prevented from lowering.

In consideration of variations in the rated power value of heater lamp 64 during manufacture, the current characteristics, luminous efficiency and heat exchange efficiency of the heater lamp 64 during burst driving as in the present invention, variations in the wall thickness of heating roller 61, environmental variables such as ambient temperature and humidity, the material and water absorption of recording sheet P, and like factors, the coefficient K1*m* associated with switching of the 'm'th heater lamp 64 between the first power control mode and the second power control mode can be determined from for example:

(1) heating efficiency η obtained from the ratio between an input power for burst driving that is determined theoretically and an input power that is actually inputted to the heater lamp 64;

(2) burst-driving efficiency ηB obtained from the ratio between an increase in the input power for burst driving which is determined theoretically and an increase in the input power that is inputted in actual burst driving until the target temperature is first reached during a printing operation; or (3) burst-driving efficiency ηA obtained from the ratio between an increase in the input power for burst driving that is determined theoretically and an increase in the input power that is inputted in actual burst driving throughout a printing operation. Though depending upon conditions, the coefficient K1*m* associated with switching between the first power control mode and the second power control mode is about 0.3 in the present embodiment for example. Usually, the coefficient K1*m* ranges from about 0.1 to about 0.45 through depending upon such parameters as rated power value, setting value of electric power, second control cycle and its predetermined duration, type and number of heater lamps used, control method and its characteristics, and construction of the roller.

The switching control means 84 comprises a switching device 84*a* such as a relay, and the like and is configured to perform switching between the first and second power control modes by switching the switching device 84*a* based on the status of operation of each component of the image forming apparatus 100. Specifically, the switching control means 84 performs switching in cases where the surface temperature of the heating roller 61 becomes lower than the fixed temperature due to continuous printing and hence cannot be raised quickly by the allowable value of power which can be supplied to the heater lamp 64 in the first power control mode while a power not lower than the allowable power value can be supplied to the heater lamp 64 because of a low driving power consumption of the components, or like cases.

Figure 5:
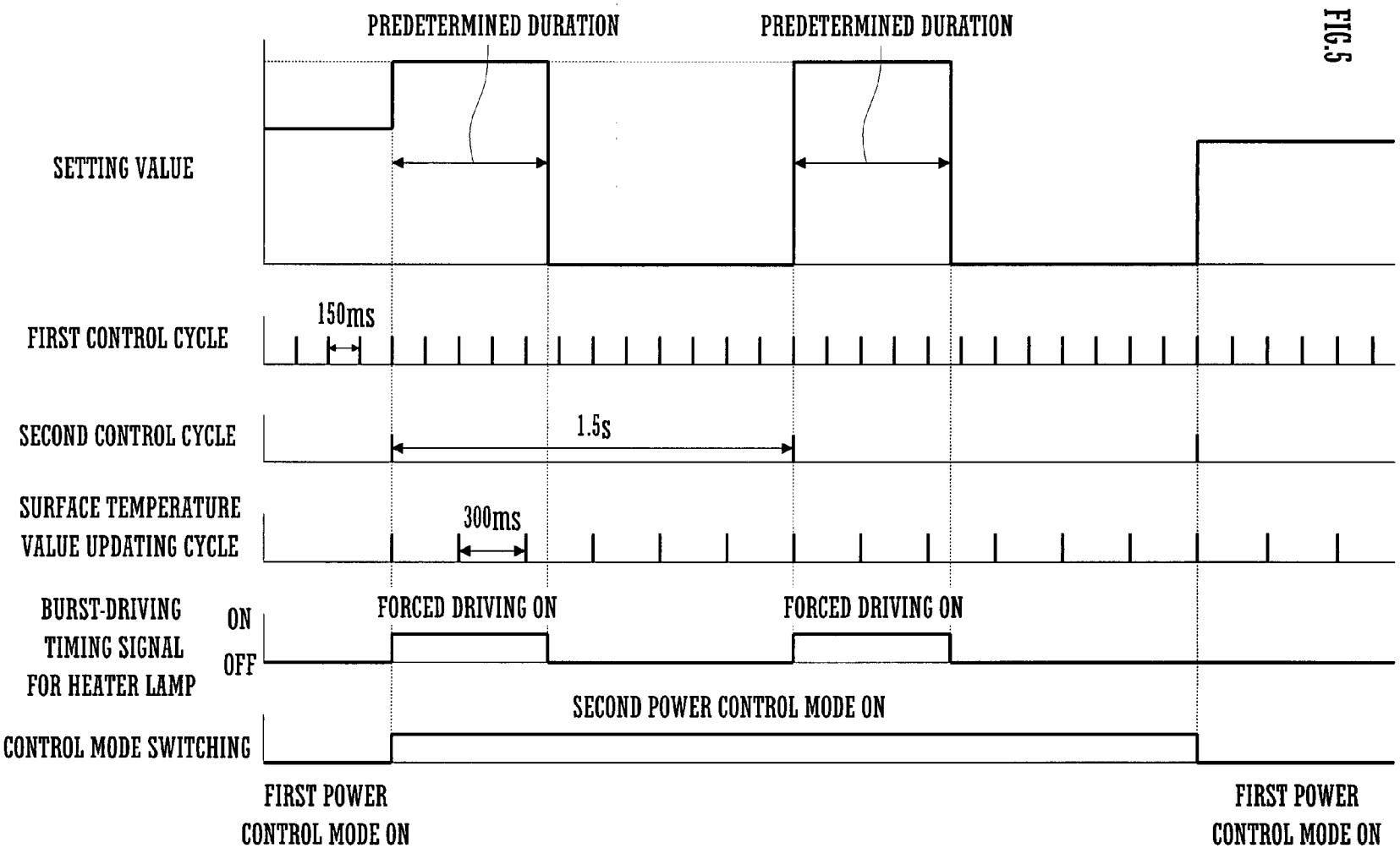
FIG. 5 is a timing chart of power control over a heater lamp of a fixing device according to an embodiment of the present invention.

In order to provide synchronism between control operations in respective of the first and second power control modes, the second control cycle, which is the control cycle of the second power control section (second power control mode), is set to a value that is an integer times as large as the first control cycle, which is the control cycle of the first power control section (first power control mode), as shown in FIG. 5.

For example, the first power control mode is set to have a 150 ms cycle and the second power control mode set to have a 1.5 s cycle in this embodiment.

The switching between the first power control mode and the second power control mode is synchronously performed with the second control cycle as shown in FIG. 5. Since the switching between the power control modes is synchronously performed with the second control cycle which is longer than the first control cycle, it is not possible that the second power control mode starts and stops halfway through the second control cycle and, therefore, there is no possibility that power control is performed incompletely. For this reason, the burst driving starts and stops with proper timing. Also, since the first control cycle is shorter than the second control cycle, even when the power control mode is switched to the first power control mode halfway through the first control cycle, the next cycle starts immediately thereafter to allow the power control to be performed properly.

Further, in order to time the updating cycle for updating the value of surface temperature of the heating roller 61 received from the thermistor 66 to the control operation in the first power control mode, the updating cycle is set to a value that is an integer times as large as the first control cycle as shown in FIG. 5. In this embodiment the updating cycle for updating the value of surface temperature of the heating roller 61 is set to 300 ms for example relative to the first control cycle of 150 ms.

Since the second control cycle and the updating cycle for updating the value of surface temperature of the heating roller 61 are each an integer times as large as the first control cycle, the first and second power control modes and update of the value of surface temperature of the heating object synchronize to each other and, hence, their respective start timings will never be off. For this reason, each control mode can be started with more proper timing by switching between the first power control mode and the second power control mode having their respective control cycles accurately synchronizing to each other. Also, since the updating cycle for updating the value of surface temperature is synchronous with the first control cycle, update of the value of surface temperature is not made with off timing and control over the setting value of electric power based on the surface temperature of the heating roller 61 even in the first power control mode can be performed accurately based on an updated value.

Further, the number of non-illustrated timer means for controlling the cycles can be reduced since these cycles synchronize to each other. For this reason, the arrangement of such timer means becomes compact, which makes it possible to reduce the cost.

With this arrangement, in cases where the image forming apparatus 100 is supplied with electric power in excess due to a decrease in the power consumption of the components while the heating roller 61 needs to be supplied with a power exceeding the allowable power value, the mode can be switched to the second power control mode to perform burst driving (forced driving) so that the heater lamp 64 is additionally supplied with the excess of power, whereby a shortage in the power required for the heater lamp 64 can be compensated for. Thus, the performance in heating recording sheet P via the heating roller 61 can be prevented from lowering and, hence, the image quality can be prevented from degrading.

By supplying the heater lamp 64 with power at predetermined time intervals to burst-drive the heater lamp 64, rush voltage is generated every time the heater lamp 64 is supplied with power. This allows a mean value of power that is actually supplied to the heating lamp 64 to become higher than the setting value of electric power. Thus, in cases where the image forming apparatus 100 is supplied with electric power without excess due to the power consumption of the components being high, even when the setting value of electric power in the second power control mode is set equal to the allowable power value that can be outputted in the first power control mode, the power actually supplied to the heating roller 61 becomes higher than the setting value of electric power, whereby a shortage in the power required for the heating roller 61 can be compensated for. For this reason, the performance in heating recording sheet P via the heating roller 61 can be prevented from lowering.

Embodiment 2

Figure 6:
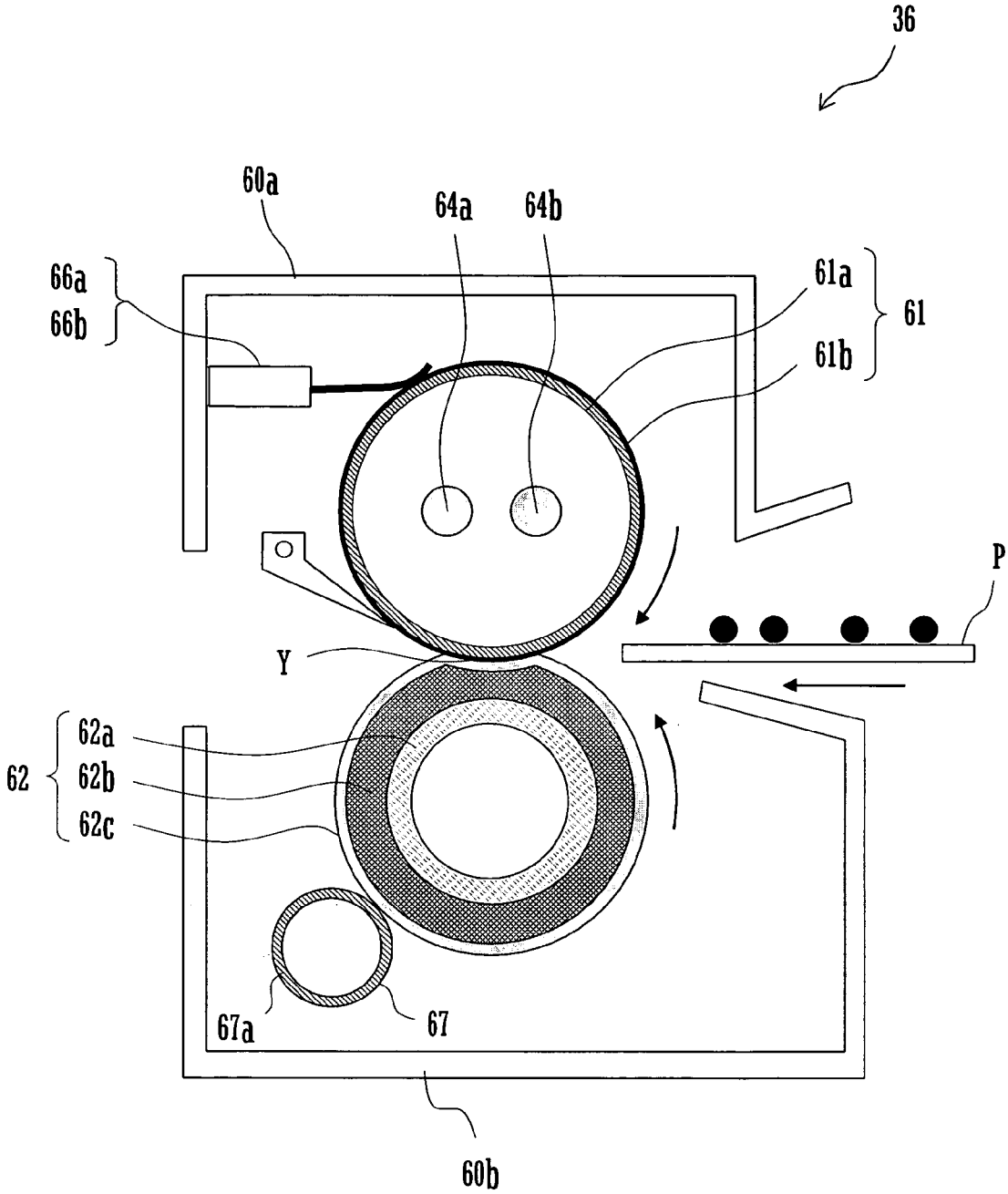
FIG. 6 is a sectional view schematically showing the construction of the fixing device.

FIG. 6 is a sectional view schematically showing the construction of a fixing device according to an embodiment of the present invention. As shown in FIG. 6, the fixing device 36 according to this embodiment is similar to embodiment 1 in major components but includes two heater lamps 64*a* and 64*b* within heating roller 61, the heater lamps 64*a* and 64*b* having different heat distributions for heating the heating roller 61. The heater lamp 64*a* has a rated power of 740 W and provides a center-high heat distribution pattern. The heater lamp 64*b* has a rated power of 445 W and provides an end-high heat distribution pattern. Thermistors 66*a* and 66*b* in relation to respective of the heater lamps 64*a* and 64*b* are disposed at axially central portion and end portion, respectively, of the surface of the heating roller 61.

The heating roller 61 and pressurizing roller 62 are each similar in operation, function and the like as in embodiment 1 but are each slightly different from the corresponding one of embodiment 1 due to the provision of the two heater lamps 64*a* and 64*b* and the like. The heating roller 61 includes a core 61*a* having a wall thickness of about 0.15 to 2 mm and formed from STKM or high tensile steel. The core 61*a* is formed to have an outer diameter of 40 mm except its axially opposite end portions having a decreased outer diameter of 30 mm.

On the other hand, the pressurizing roller 62 comprises a core 62*a* having an outer diameter of 28 mm and formed from STKM, a heat-resistant resilient layer 62*b* covering the outer periphery of the core 62*a* and formed from low-heat-conductivity silicone rubber, a release layer 62*c* covering the outer periphery of the heat-resistant resilient layer 62*b* and comprising an electrically conductive PFA tube of which the resistivity is adjusted by dispersion of carbon. The pressurizing roller 62, as a whole, has an outer diameter of 40 mm.

Figure 7:
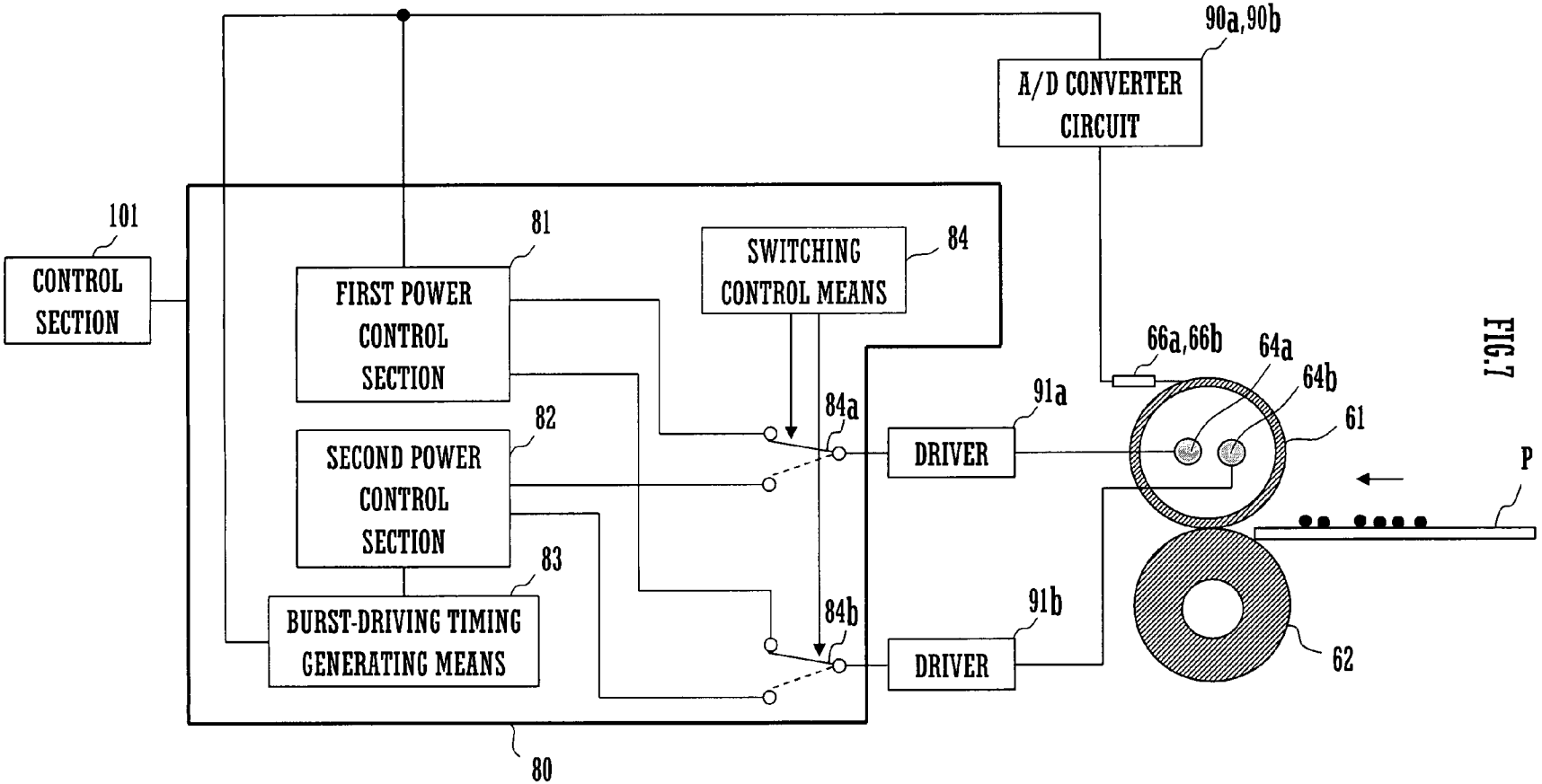
FIG. 7 is a block diagram showing the configuration of a power control section included in the fixing device.

FIG. 7 is a block diagram showing the configuration of a power control section included in a fixing device according to an embodiment of the present invention. The power control section 80 obtains values of surface temperature of the heating roller 61 from the thermistors 66*a* and 66*b* via respective of A/D converter circuits 90*a* and 90*b* as in the above-described embodiment 1. The power control section 80 determines setting values of powers to be supplied to respective of the heater lamps 64*a* and 64*b* based on respective of the surface temperature values of the heating roller 61 obtained, and supplies the heater lamps 64*a* and 64*b* with the respective powers via drivers 91*a* and 91*b*. Second power control means 82, which is connected to the heater lamps 64*a* and 64*b* via switching control means 84 and the driver 91*a* and 91*b*, determines setting power values using the above-noted expression (1) used in embodiment 1 and supplies the heater lamps 64*a* and 64*b* with powers of the respective setting values for a predetermined duration in response to burst-driving timing generating means 83.

Here, the burst-driving timing generating means 83 is connected to the thermistors 66*a* and 66*b* via the A/D converter circuits 90*a* and 90*b* and determines the predetermined duration for which the powers of the setting values of electric power are outputted based on conditions of variation in the surface temperature of the heating roller 61 or processing conditions for heating recording sheet P. For example, the burst-driving timing generating means 83 determines the predetermined duration based on a rate of change in the surface temperature of the heating roller 61 detected by each of the thermistors 66*a* and 66*b*. Specifically, if the rate of rise in the surface temperature of the heating roller 61 is low, the predetermined duration is lengthened, while, if the rate of rise is high, the predetermined duration is shortened.

Examples of such conditions of variation in the surface temperature of the heating roller 61 include, in addition to the aforementioned condition, surface temperatures of the heating roller 61 detected by the respective thermistors 66*a* and 66*b*, and a temperature difference determined from surface temperatures of the heating roller 61 detected by the respective thermistors 66*a* and 66*b* located in different regions. Examples of such processing conditions for heating recording sheet P include a time passed from the start of heating of recording sheet P by the heating roller 61, and the size of recording sheet P. The aforementioned predetermined duration may be determined based on one of these conditions or a combination of plural conditions depending on the construction of the fixing device 36. Thus, the power actually supplied to the heating means can be properly controlled. Since the powers actually supplied to the heater lamps 64*a* and 64*b* fail to become much higher than required, it is possible to avoid an excessive rise in the surface temperature of the heating roller 61, as well as to reduce power consumption in the second power control mode.

Figure 8:
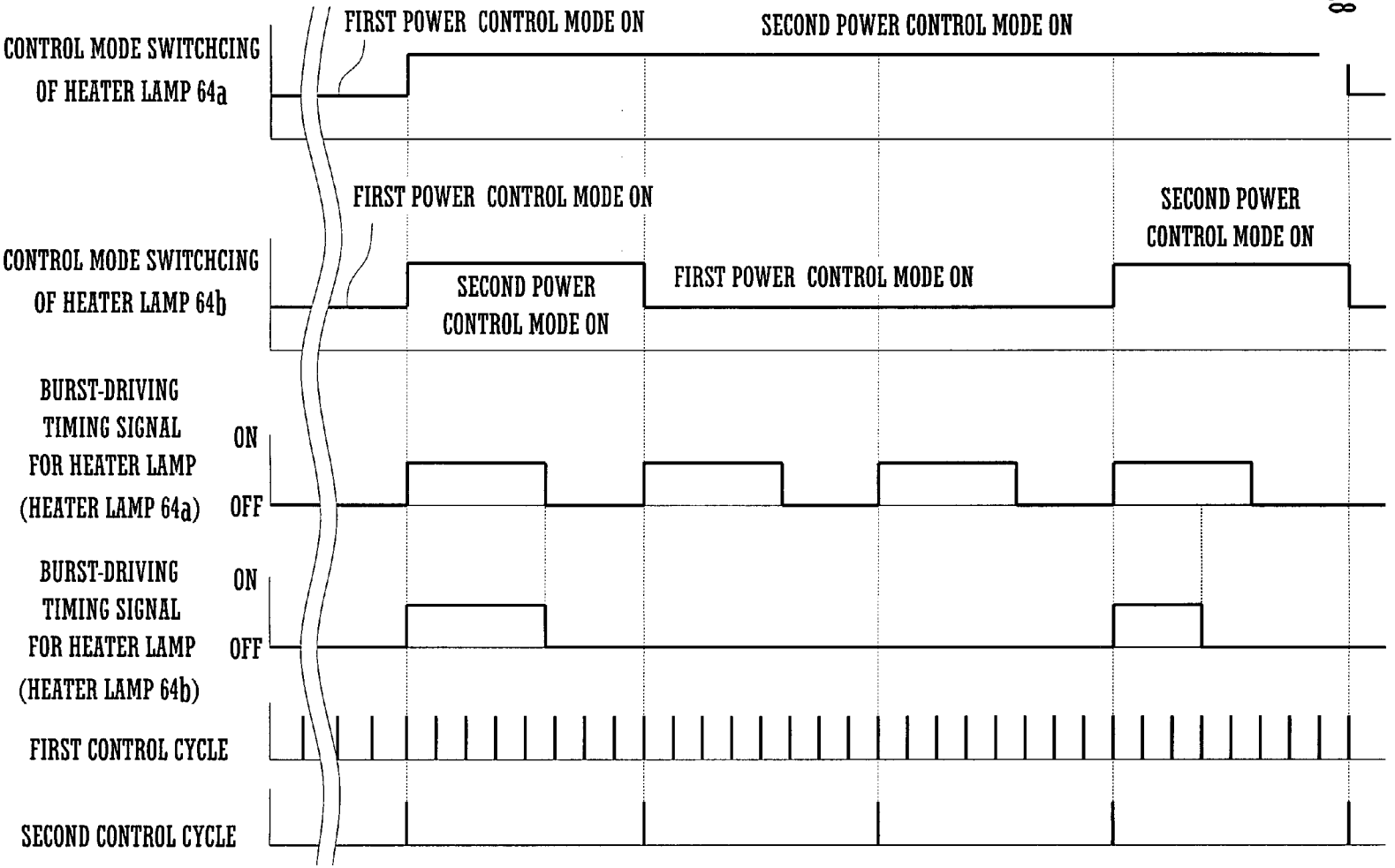
FIG. 8 is a timing chart of power control over heater lamps of the fixing device.

It is possible to determine the predetermined duration for each of the heater lamps 64*a* and 64*b* as shown in the timing chart at FIG. 8. This arrangement makes it possible to burst-drive each of the heater lamps 64*a* and 64*b* properly, as well as to suppress wasteful power consumption in the second power control mode more effectively.

Further, it is possible that the switching control means 84 is connected to the thermistors 66*a* and 66*b* via the A/D converter circuits 90*a* and 90*b* to allow the aforementioned conditions for determining the predetermined duration to be used in judgment as to whether or not to perform switching between the first power control mode and the second power control mode. With this arrangement, when the recording sheet size is small for example, switching of the heater lamp 64*b*, which provides an end-high heat distribution pattern as shown in the timing chart at FIG. 8, to the second power control mode is not performed. This is because, since recording sheet P of such a small size passes over not axially end portions but axially central portion of the heating roller 61, the image quality can be prevented from degrading if only the heater lamp 64*a* providing a center-high heat distribution is switched to the second power control mode without burst-driving the heater lamp 64*b* in the second power control mode. Thus, the heater lamp 64 that is currently suited to operate in the second power control mode can be selected, whereby power consumption in the second power control mode can be suppressed with the performance in heating recording sheet P prevented from lowering.

Also, it is possible that the setting value of power to be supplied to the heater lamp 64*a* having the higher rated power value in the second power control mode is fixed to 740 W, which is the rated power value of the heater lamp 64*a*. That is, since the heater lamp 64*a* of the higher rated power value generates a larger amount of heat than the heater lamp 64*b* of the lower rated power value, the surface temperature of the heating roller 61 can be raised more rapidly by adjusting the setting value of electric power of the heater lamp 64*a* in the second power control mode to the rated power value thereof to increase the amount of heat. In this case, the setting value of electric power of the heater lamp 64*b* need be adjusted so that the components of the image forming apparatus 100 are prevented from being affected by shortage of electric power.

As in embodiment 1, the location of temperature detection is not limited to the surface of the heating roller 61. Also, temperature detection may be achieved regardless of whether directly or indirectly and whether or not the temperature detection means is in contact with the heating roller 61.

Embodiment 3

Figure 9:
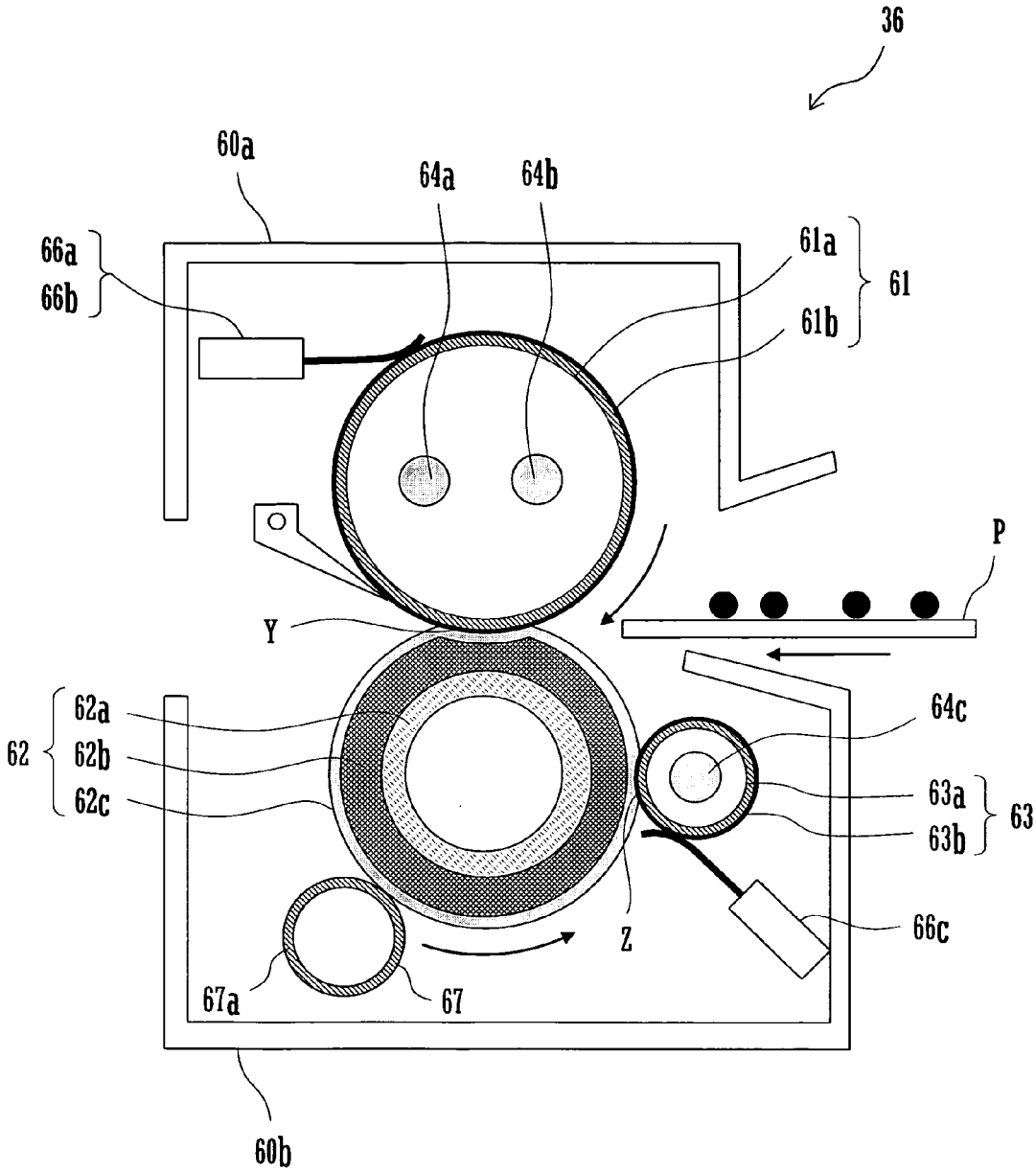
FIG. 9 is a sectional view schematically showing the construction of the fixing device.

FIG. 9 is a sectional view schematically showing the construction of a fixing device according to an embodiment of the present invention. As shown in FIG. 9, the fixing device 36 according to this embodiment is similar to embodiment 2 in major components but includes an external heating roller 63 corresponding to the transmission member defined by the present invention, and a thermistor 66*c* for detecting the surface temperature of the external heating roller 63. The external heating roller 63 has a hollow cylindrical shape, includes a heater lamp 64*c* therewithin, and is configured to heat the pressurizing roller 62. The external heating roller 63 abuts against the surface of the pressurizing roller 62 by a predetermined force on the side upstream of a fixing nip area Y in the counterclockwise direction to define a heating nip area Z (having a nip width of 1 mm in this embodiment) in the contact region between the pressurizing roller 62 and the external heating roller 63.

The external heating roller 63 comprises a hollow cylindrical metal core 63*a* formed from aluminum, an iron material or a like material, a heat-resistant release layer 63*b* covering the outer periphery of the metal core 63*a* and formed from a synthetic resin material that is excellent in heat resistance and release property. Examples of such synthetic resins for the heat-resistant release layer 63*b* include, for example, elastomers formed from silicone rubber, fluororubber and the like, and fluororesins formed from PFA, PTFE and the like.

Figure 10:
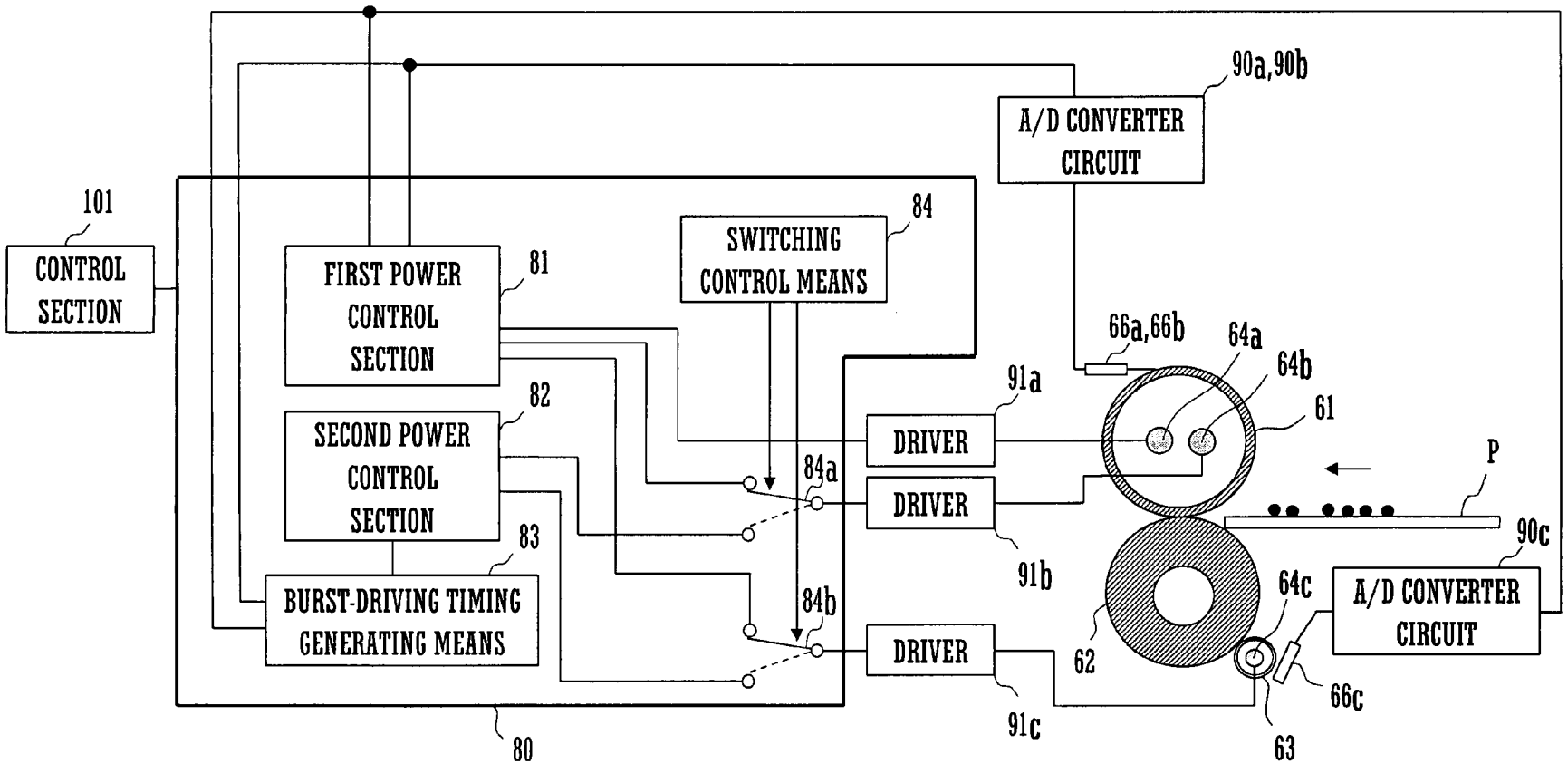
FIG. 10 is a block diagram showing the configuration of a power control section included in the fixing device.

In the above-described construction, as shown in FIG. 10, the thermistor 66*c* is connected to the first power control section 81 and the burst-driving timing control means 83 via A/C converter circuit 90*c*, while the heater lamp 64*c* connected to the second power-control section 82 via driver 91*c* and switching control means 84. the setting value of electric power of the heater lamp 64*c* is controlled based on the surface temperature of the external heating roller 63 obtained by the first power control section via the A/D converter circuit 90*c* in the first power control mode. Further, like the heater lamps 64*a* and 64*b*, the heater lamp 64 is switched between the first power control mode and the second power control mode by the switching control means 84. Since this arrangement allows the surface temperature of the external heating roller 63 to be maintained properly, the surface of the pressurizing roller 62 can be heated properly, whereby recording sheet P can be sufficiently heated by the pressurizing roller 62 as well. Thus, it is possible to prevent the performance in heating recording sheet P from lowering, hence, prevent the image quality from degrading more effectively.

In the present embodiment, the metal core 63*a* comprises a roller of an aluminum alloy having a diameter of 15 mm and a wall thickness of 0.5 mm. The heat-resistant layer 63*b* comprises a 25 μm-thick baked coat formed from a synthetic resin comprising a mixture of PFA and PTFE and covering the outer periphery of the metal core 63*a*. The heater lamp 64*c* has a rated output of 400 W and provides a flat heat distribution pattern for distributing heat over the entire roller surface uniformly.

In the present embodiment, the heater lamp 64*a* of the highest rated power value for providing a center-high heat distribution pattern is controlled in the first power control mode only without being switched to the second power control mode, while the other two heater lamps 64*b* and 64*c* are subjected to switching between the first power control mode and the second power control mode. By failure to switch the heater lamp 64*a* of the highest rated power value to the second power control mode, power consumption in the second power control mode can be suppressed to suppress the occurrence of shortage in the power required to burst-drive the other heater lamps 64*b* and 64*c* in the second power control mode.

Further, in the present embodiment, control start timings for respective of the heater lamps 64*a* and 64*b* are sequentially staggered 100 ms by 100 ms from control start timing for the heater lamp 64*c* serving as a reference. Specifically, since the updating cycle for updating surface temperatures of the heating roller 61 and external heating roller 63 detected by the thermistors 66*a* to 66*c* is 300 ms, control over the heater lamp 64*b* is started 100 ms after start of control over the heater lamp 64*c* and then control over the heater lamp 64*a* started 200 ms after the start of control over the heater lamp 64*c* in the first power control mode. In this case, the control start timings for the two heater lamps 64*a* and 64*b* need be staggered within one updating cycle for updating surface temperatures of the heating roller 61 and external heating roller 63 detected by the thermistors 66*a* to 66*c*. If the interval between these control start timings exceeds one updating cycle, the heater lamps 64*a* to 64*c* are controlled in each control mode based on surface temperatures of the heating roller 61 and external heating roller 63 that are obtained at different updating times undesirably. The above-described arrangement is provided for the purpose of avoiding such an inconvenience. This interval is not particularly limited to 100 ms setting in this embodiment as long as the control start timings are staggered within one updating cycle for updating the surface temperatures.

Figure 11:
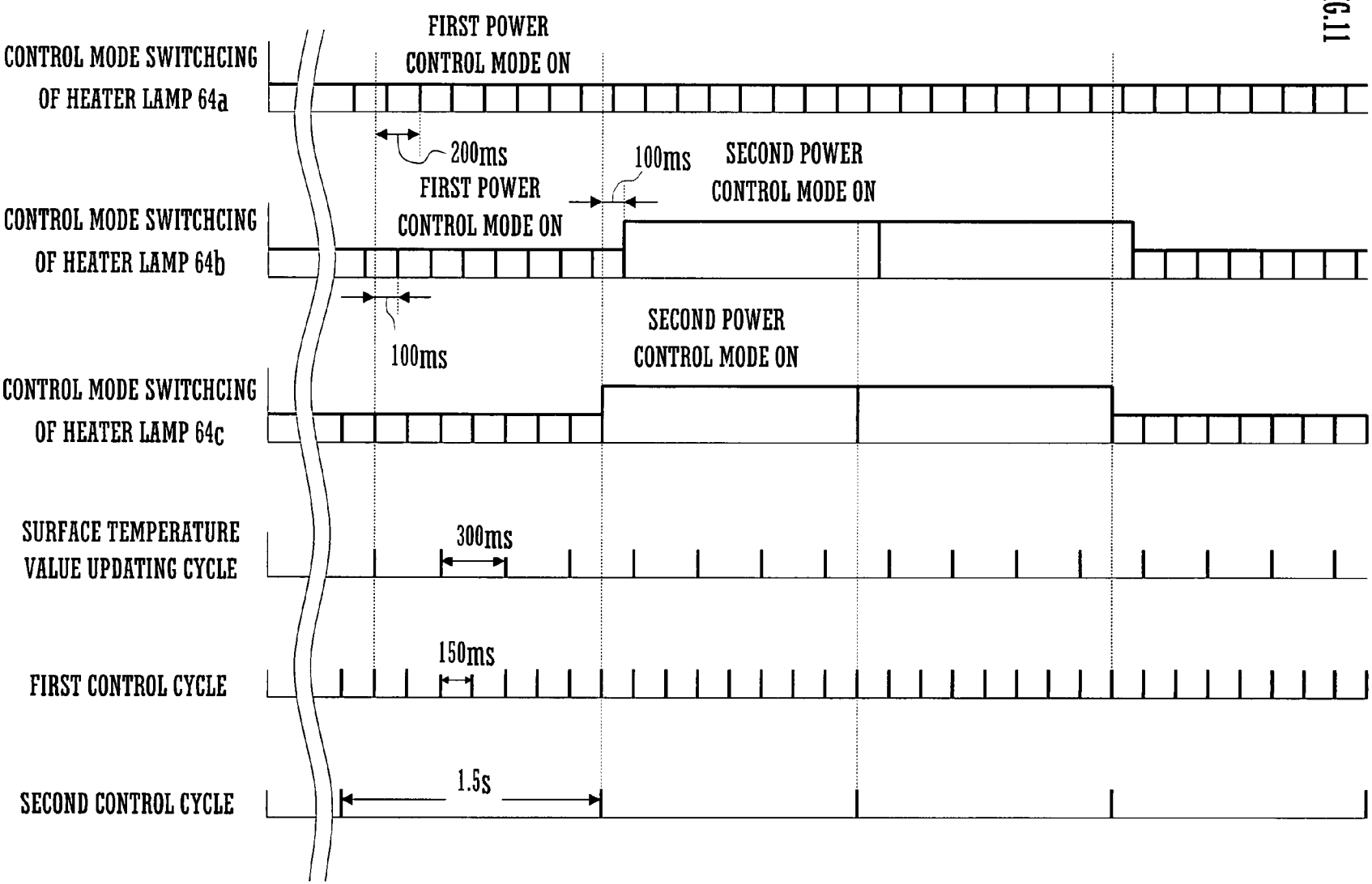
FIG. 11 is a timing chart of power control over heater lamps of the fixing device.

Since control start timings for respective of the plural heater lamps 64*a* to 64*c* in each control mode are different from each other, large power fluctuations and increase in noise, which would otherwise occur if the plural heating lamps 64*a* to 64*c* start being controlled, can be reduced, whereby the occurrence of shortage in the power required for burst driving in the second power control mode can be suppressed. In FIG. 11 control start timings are illustrated in the control mode switch timing charts of the respective heater lamps 64*a* to 64*c* so as to be seen clearly.

Embodiment 4

Figure 12:
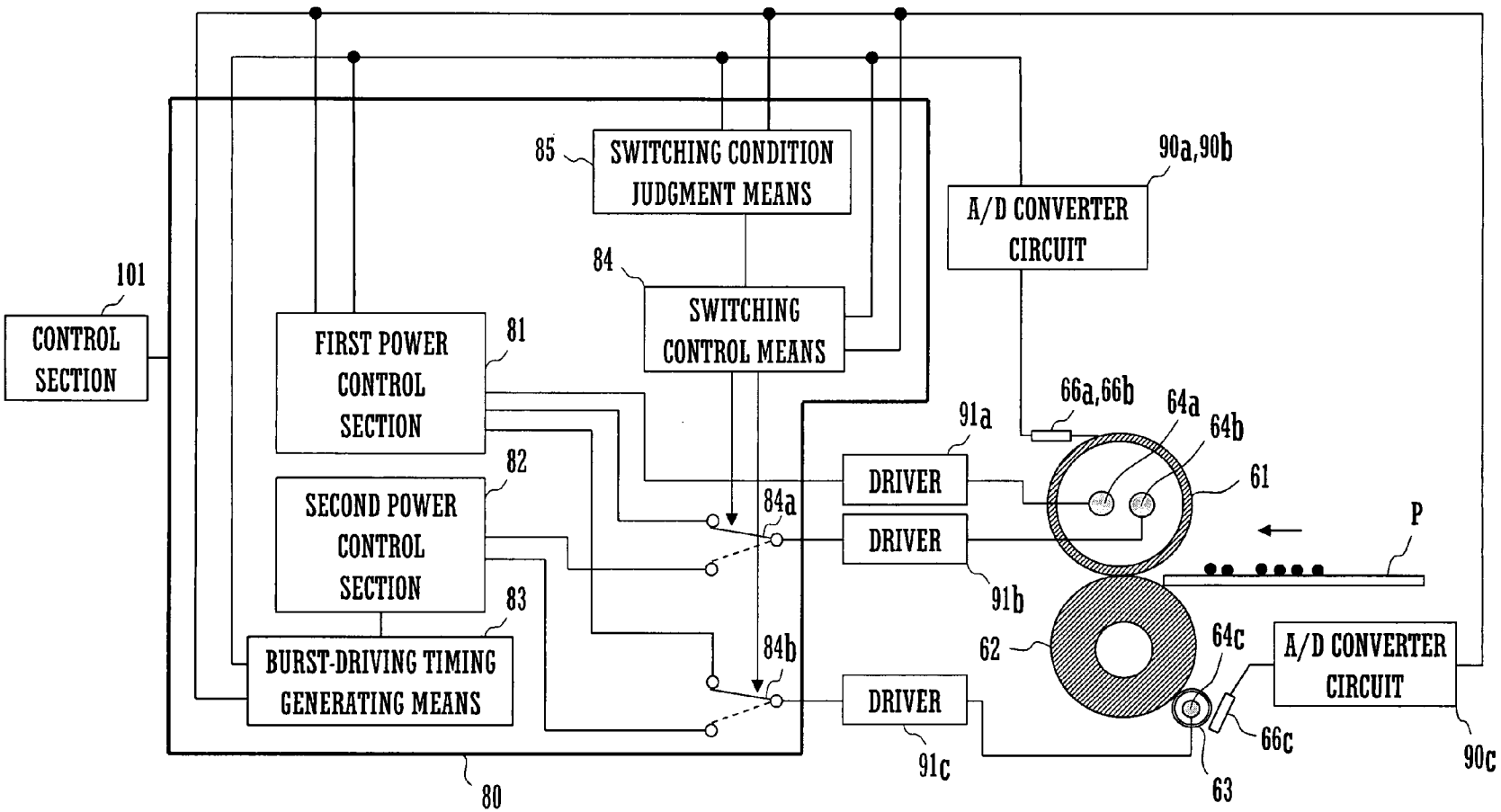
FIG. 12 is a block diagram showing the configuration of a power control section included in the fixing device.

This embodiment is similar to the fixing device 36 according to embodiment 3 shown in FIG. 9. The configuration of power control section 80 is substantially similar as in embodiment 3, but the power control section 80 according to this embodiment includes switching condition judgment means 85 as shown in FIG. 12. The switching condition judgment means 85 is connected to the switching control means 84 and to the thermistors 66*a* to 66*c* via and the A/D converter circuits 90*a* to 90*c* and configured to judge whether or not to perform switching to the second power control mode. Also, the switching condition judgment means 85 monitors various parameters (surface temperatures of the heating roller 61 and external heating roller 63 detected by the thermistors 66*a* to 66*c* in this embodiment) to make judgment as to whether the parameters meet a switching operation stop condition or a switching operation restart condition, which is the judgment as to whether or not to perform switching to the second power control mode, and outputs the result of judgment to the switching control means 84.

If the switching condition judgment means 85 judges the parameters as meeting the switching operation stop condition, the switching control means 84 inhibits switching from the first power control mode to the second power control mode. In the case where the second power control mode works currently, the second power control mode is forcibly switched to the first power control mode at the time the currently proceeding cycle terminates.

On the other hand, if the switching condition judgment means 85 judges the parameters as meeting the switching operation restart condition when switching to the second power control mode is inhibited by the switching operation stop condition, the inhibition of switching to the second power control mode is cancelled.

In the present embodiment, the target surface temperature of each of the heating roller 61 and the external heating roller 63 is set to 190° C., while the switching operation stop conditions for respective of the heater lamps 64*a* to 64*c* are conditions where surface temperatures of the heating roller 61 and external heating roller 63 are 186° C. or higher according to detection by the respective thermistors 66*a* to 66*c*. The switching operation restart conditions are conditions where surface temperatures of the heating roller 61 and external heating roller 63 are 184° C. or lower according to detection by the respective thermistors 66*a* to 66*c*.

It is possible that the switching operation stop condition and the switching operation restart condition share the same surface temperature of each of the heating roller 61 and the external heating roller 63.

The switching operation stop condition and the switching operation restart condition are not limited to the aforementioned conditions but may be judged based on conditions of variation in each of the surface temperatures of the heating roller 61 and external heating roller 63 or processing conditions for heating recording sheet P. Examples of such conditions of variation in each of the surface temperatures of the heating roller 61 and external heating roller 63 include a temperature difference determined from temperatures detected by the respective thermistors 64*a* to 64*c*, and a rate of change in the temperature detected by each of the thermistors 64*a* to 64*c*. Examples of such processing conditions for heating recording sheet P include a time passed from the start of heating of recording sheet P by the heating roller 61, and the size of recording sheet P. A plurality of such conditions may be combined.

Thus, when switching to the second power control mode is not necessary, the switching to the second power control mode is disabled so that control is performed in the first power control mode only. For this reason, it is possible to prevent an excessive rise in the surface temperatures of the heating roller 61 and external heating roller 63, hence, maintain the surface temperatures of the heating roller 61 and external heating roller 63. Thus, power consumption in the second power control mode can be suppressed.

Further, it is possible that an additional thermistor is provided on the surface of pressurizing roller 62 and the surface temperature of the pressurizing roller 62 is used in judging the switching operation stop condition and the switching operation restart condition. The external heating roller 63 heats the surface of the heating roller 61 to maintain the surface temperature of the pressurizing roller 62 properly. Accordingly, if the surface temperature of the pressurizing roller 62 is used in judging the switching operation stop condition and the switching operation restart condition, judgment as to whether or not to perform switching to the second power control mode can be made correctly. Thus, when switching to the second power control mode is not necessary, the switching to the second power control mode is disabled so that the setting value of electric power of the heater lamp 64*c* is controlled in the first power control mode only. For this reason, it is possible to prevent an excessive rise in the surface temperature of the pressurizing roller 62, hence, maintain the surface temperature of the pressurizing roller 62 properly. In this way, power consumption in the second power control mode can be suppressed.

The judgment as to whether or not to perform switching to the second power control mode is disabled until a fixed period of time has passed or until the number of recording sheets P having been heated exceeds a predetermined number from the start of heating of recording sheet P by the heating roller 61. With this arrangement, the switching to the second power control mode can be prevented from being inhibited during the initial stage of heating of recording sheet P during which the surface temperatures of the heating roller 61 and external heating roller 63 are unstable. For this reason, the surface temperatures of the heating roller 61 and external heating roller 63 can be properly maintained by performing the switching between the first power control mode and the second power control mode.

Figure 13A:
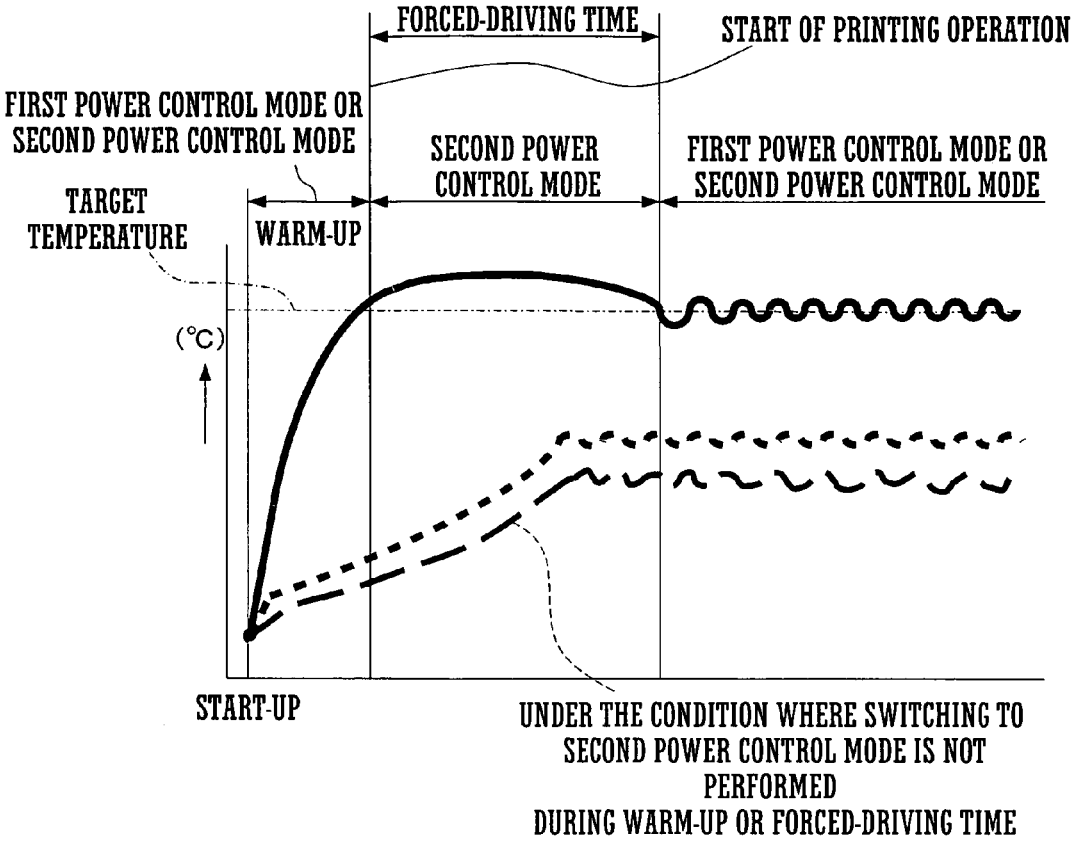
FIG. 13 is a chart showing changes in the surface temperatures of respective of a heating roller and a pressurizing roller 62 included in the fixing device.
Figure 13B:
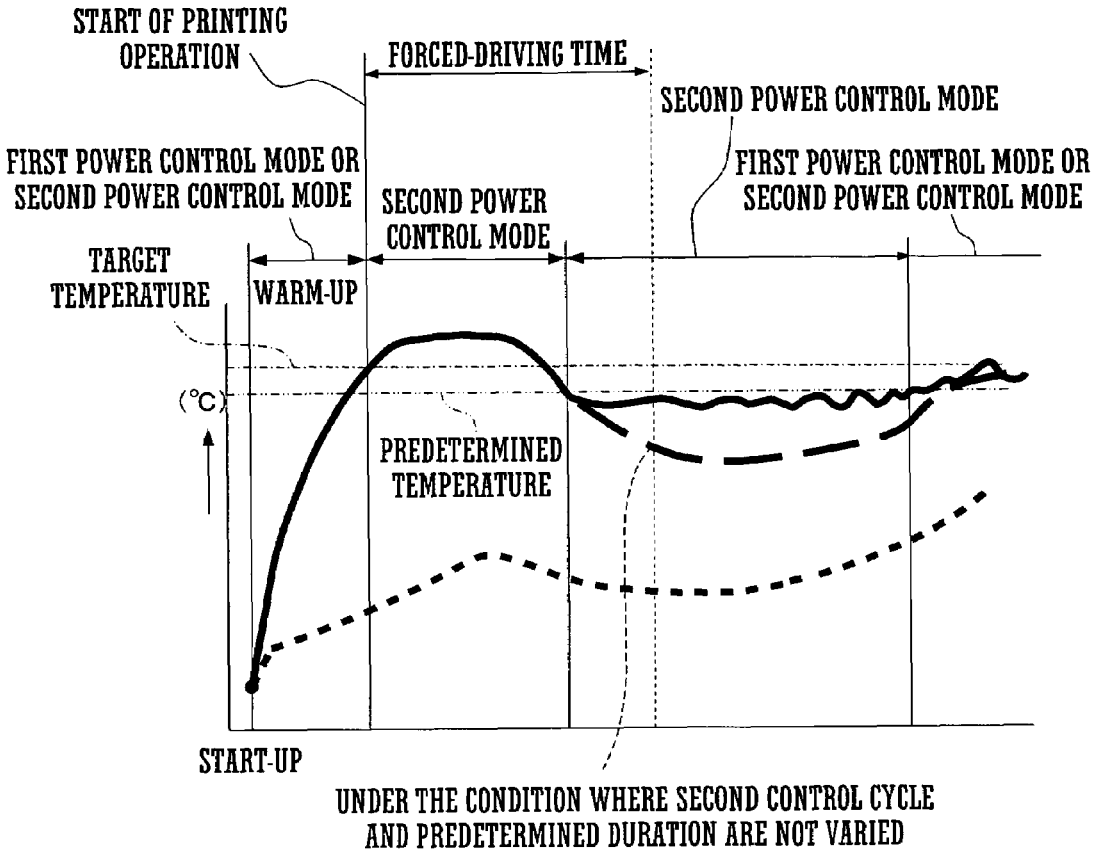

FIG. 13 is a chart showing changes in the surface temperatures of respective of the heating roller and pressurizing roller 62 included in a fixing device according to an embodiment of the present invention. A warm-up operation for heating the heating roller 61 and the pressurizing roller 62 is performed when the image forming apparatus 100 is started up or to make the image forming apparatus 100 assume a ready-to-print state from a standby state in a power-saving mode. Even during the warm-up operation, the heater lamps 64*a* to 64*c* are supplied with power by switching between the first power control mode and the second power control mode. The warm-up operation terminates at the time the surface temperature of the heating roller 61 reaches the target temperature, as shown in FIG. 13. The switching control means 84 forcibly performs switching to the second power control mode upon the start of the printing operation immediately following the stop of the warm-up operation to burst-drive the heater lamps 64*a* to 64*c* until a predetermined forced-driving time has passed.

Usually, the heating roller 61 having a thin wall (wall thickness of about 0.1 to 2.0 mm) has a small heat capacity because of its thin wall and hence can be heated to the target temperature quickly. On the other hand, the pressurizing roller 62 usually has a larger wall thickness than the heating roller 61, hence a larger heat capacity than the heating roller 61. For this reason, the temperature of the pressurizing roller 62 is not raised very quickly under heating by the warm-up operation in the first power control mode, as shown in FIG. 13(*a*). In addition, the medium to be heated deprives the pressurizing roller 62 of heat when the printing operation starts. For this reason, the temperature of the pressure member is difficult to rise immediately after the completion of the warm-up operation.

If the switching to the second power control mode is performed during the warm-up operation, the temperature of the heating roller 61 can be raised quickly and, hence, the warm-up operation time can be shortened significantly. For this reason, the waiting time up to the completion of the warm-up operation can be shortened significantly. Further, the pressurizing roller 62 also is applied with heat from the surface of the heating roller 61 as well as from the surface of the external heating roller 63, the surface temperature of the pressurizing roller 62 can also be raised quickly.

By forcibly causing the second power control mode to work from the start of the printing operation immediately following the stop of the warm-up operation until the predetermined forced-driving time has passed, the surface temperature of the pressurizing roller 62 can be raised quickly and maintained at an appropriate temperature by heat applied from the heating roller 61 and the external heating roller 63 even when the printing operation starts. For this reason, it is possible to heat recording sheet P sufficiently by the pressurizing roller 62 as well, hence, prevent the performance in heating recording sheet P from lowering.

As shown in FIG. 13(*b*), the second control cycle and the predetermined duration are varied and the second power control mode is caused to work before or immediately after passing of the predetermined forced-driving time as long as the surface temperature of the heating roller 61 remains below a predetermined setting temperature, whereby the heater lamps 64*a* and 64*b* heating the heating roller 61 can be supplied with a higher power than in the currently working second power control mode until the surface temperature of the heating roller 61 reaches the predetermined setting temperature or higher.

In cases where the surface temperature of the heating roller 61 remains below the predetermined setting temperature before or immediately after passing of the predetermined forced-driving time, the heating roller 61 is not sufficiently heated due to heat transfer to recording sheet P and the like, heat dissipation into the atmosphere, changes in the ambient conditions, or like factors which are much more intense than originally estimated. In such cases, though switching to the second power control mode is performed even during the predetermined forced-driving time or immediately after passing of the predetermined forced-driving time, heat is not sufficiently supplied and, hence, the performance in heating recording sheet P is lowered at that time. For this reason, proper temperature control does not work, which causes the fixing performance to lower considerably. Thus, the desired performance cannot be maintained.

For avoiding such an inconvenience, the second control cycle of the currently working second power control mode and the predetermined duration are varied to newly setting ones to supply the heater lamps 64*a* and 64*b* with a higher power than supplied in the currently working second power mode, whereby the performance in heating the heating roller 61 is temporarily enhanced to maintain the temperature of the heating roller 61 properly. This operation is performed once or plural times repeatedly until the temperature of the heating roller 61 becomes substantially equal to or higher than the predetermined setting temperature. In the present embodiment, the second control cycle and the predetermined duration are varied for the heater lamps 64*a* and 64*b* both. However, it is possible to vary the second control cycle and the predetermined duration for either one of the heater lamps 64*a* and 64*b*.

Thus, the surface temperature of the heating roller 61 can be brought closer to the target temperature gradually. For this reason, it is possible to improve a situation in which the forced switching to the second power control mode cannot accommodate changes in the ambient conditions or like factors which are much more intense than originally estimated, hence, prevent the performance in heating recording sheet P via the heating roller 61 from lowering more effectively.

The second control cycle of the second power control mode and the predetermined duration may be previously stored in storage means so as to be capable of being read out for use when setting values thereof need to be varied. Also, arithmetic expressions and the like stored in the storage means or included in operation programs may be obtained using parameters including current surface temperatures, environmental variables (room temperature, humidity and the like), periods of time such as the operation time and the forced-driving time, the number of prints, and the size and orientation of recording sheet every time the need arises.

Embodiment 5

Figure 14:
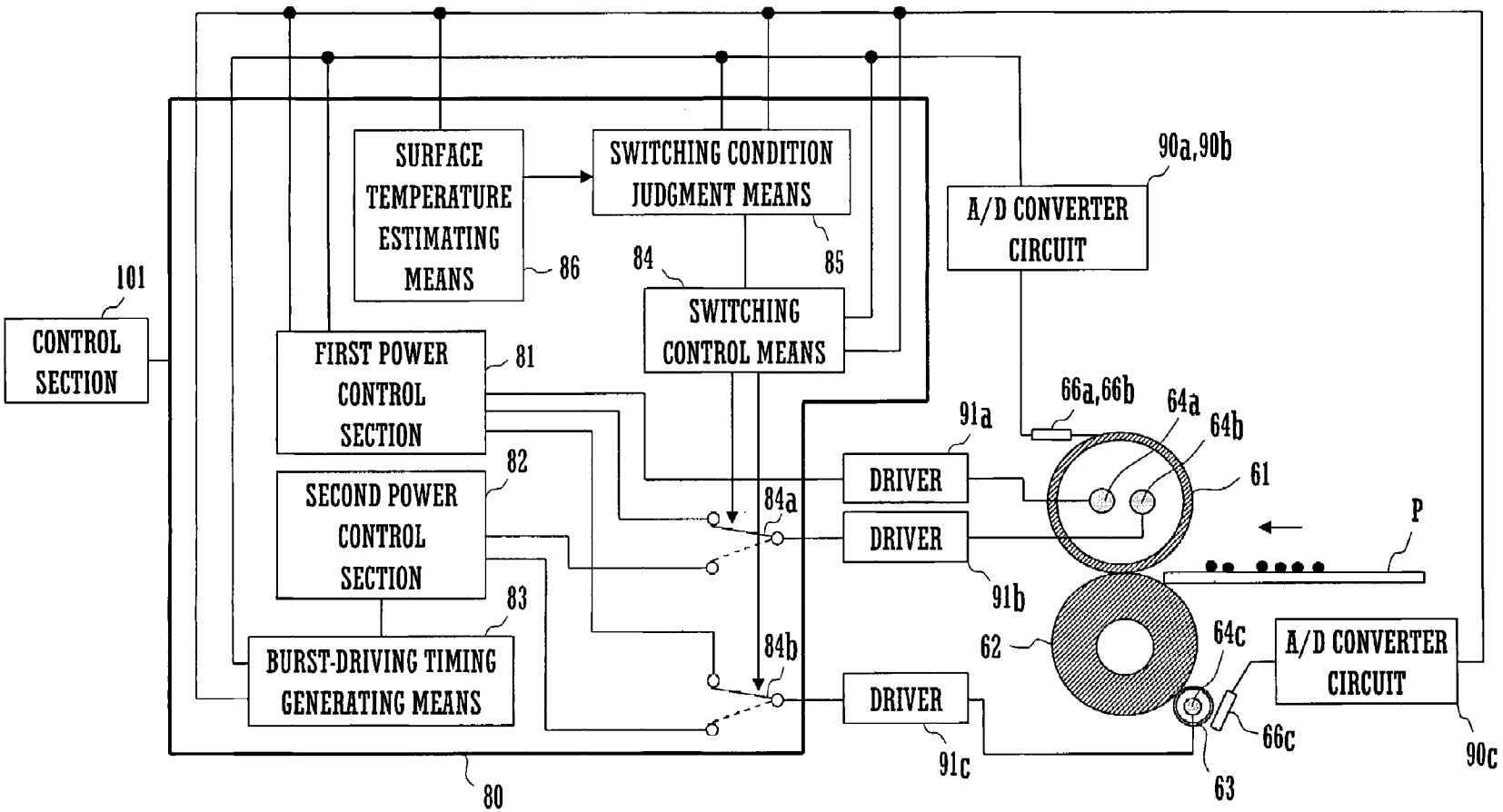
FIG. 14 is a block diagram showing the configuration of a power control section included in the fixing device.

This embodiment is substantially similar in construction to the above-described embodiment 4, but has surface temperature estimating means 86 in the power control section 80 as shown in FIG. 14. The surface temperature estimating means 86 is connected to the switching condition judgment means 85 and to the thermistor 66*c* via the A/D converter circuit 90*c* and configured to estimate the surface temperature of the pressurizing roller 62 from the surface temperature of the external heating roller 63. Also, the surface temperature estimating means 86 outputs the estimated value of surface temperature of the pressurizing roller 62 to the switching condition judgment means 85. The switching condition judgment means 85 makes judgment as to whether the switching operation stop condition or the switching operation restart condition is met based on the estimated surface temperature of the pressurizing roller 62 received. That is, unlike embodiment 4 in which the surface temperature of the external heating roller 63 is used, this embodiment uses the surface temperature of the pressurizing roller 62 in judging the switching operation stop condition and the switching operation restart condition.

The pressurizing roller 62 is in contact with the external heating roller 63, which transfers heat from its surface to the pressurizing roller 62 through the contact portion. The surface temperature of the pressurizing roller 62 becomes substantially equal to that of the external heating roller 63 when the heater lamp 64*c* is kept inactive. Further, the surface temperature of the pressurizing roller 62 becomes lower than that of the external heating roller 63 having the heater lamp 64*c*. Due to the difference in surface temperature between the pressurizing roller 62 and the external heating roller 63, the surface temperature of the external heating roller 63 drops gradually after the heater lamp 64*c* has stopped being driven. The rate of such drop in the surface temperature of the external heating roller 63 depends upon the surface temperature difference between the pressurizing roller 62 and the external heating roller 63.

Accordingly, the surface temperature of the external heating roller 63 that is detected after passing of a sufficient time period from stop driving of the heater lamp 64*c* is considered to be equal to that of the pressurizing roller 62. Also, even at the time half way through such a sufficient time period, the surface temperature of the pressurizing roller 62 can be estimated from conditions of drop in the surface temperature of the external heating roller 63 after stop driving of the heater lamp 64*c*.

Thus, the judgment can be made correctly as to whether or not to perform switching of the heater lamp 64*c* to the second power control mode without provision of additional temperature detection means. Since the surface temperature of the pressurizing roller 62 can be maintained more properly than in the case where the surface temperature of the external heating roller 63 is used, recording sheet P can be heated sufficiently by the pressurizing roller 62 as well, whereby the performance in heating recording sheet P can be prevented from lowering.

It is possible that correlation between the surface temperature of the external heating roller 63 and that of the pressurizing roller 62, which are detected after passing of a fixed time period from stop driving of the heater lamp 64*c*, is stored as a table in non-illustrated storage means. Likewise, correlation between the rate of drop in the surface temperature of the external heating roller 63 and the pressurizing roller 62 may be previously stored as a table in the storage means. By so doing, estimation of the surface temperature of the pressurizing roller 62 can be simplified.

Embodiment 6

Figure 15:
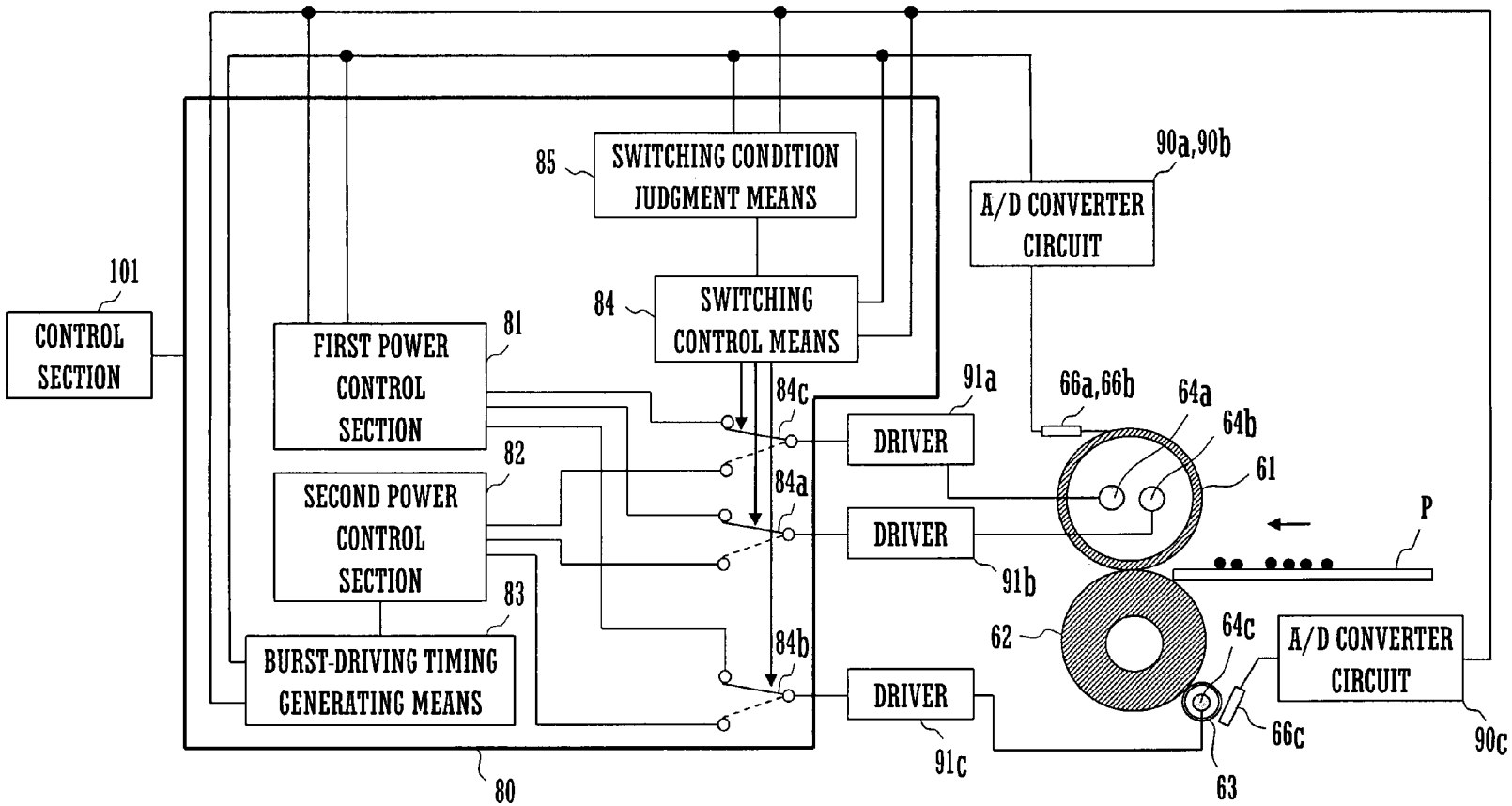
FIG. 15 is a block diagram showing the configuration of a power control section included in the fixing device.

This embodiment is substantially similar in construction to the fixing device 36 according to the above-described embodiment 4. As shown in FIG. 15, the heater lamp 64*a* is connected to the first and second power control sections 81 and 82 via the switching control means 84 including a switching device 84*c*. That is, this embodiment is configured to control the heater lamps 64*a* to 64*c* in the first and second power control modes.

In this arrangement, the external heating roller 63 comprises a metal core 63*a* having a wall thickness of 0.75 mm, and a heat-resistant release layer 63*b* formed from a fluororesin material.

In the first power control mode, the first power control cycle is 300 ms, which is equal to the updating cycle for updating the values of surface temperatures of the heating roller 61 and external heating roller 61 detected by the thermistors 66*a* to 66*c*. Also, in each control mode, control start timings for respective of the heater lamps 64*a* and 64*b* are sequentially staggered 100 ms by 100 ms from control start timing for the heater lamp 64*c* serving as a reference.

Since all the heater lamps 64*a* to 64*c* start being controlled within the time period of one first control cycle in each of the first and second power control modes, control start timings for respective of all the heating lamps 64*a* to 64*c* do not coincide with each other, large power fluctuations and increase in noise, which would otherwise occur if the plural heater lamps 64*a* to 64*c* start being controlled at the same time, can be reduced, whereby the occurrence of shortage in the power required for burst driving in the second power control mode can be prevented more reliably.

In this embodiment, the second power control cycle is 1.2 s and the setting value of electric power of the heater lamp 64*a* in the second power control mode is fixed to the rated power value.

Further, in this embodiment, during the time interval of 100 ms from the start of power supply to the heater lamp 64*b* or 64*c* in the second power control mode until the start of subsequent power supply to the heater lamp 64*b* or 64*a*, power supply to the heater lamps 64*b* and 64*c* is controlled in a slow-up fashion. For example, the value of electric power to be supplied to the heater lamp 64*c* is as large as 15 to 30% of the setting value of electric power in the first step and as large as 65 to 85% of the setting value of electric power in the second step during the time interval of 100 ms and then reaches the setting value of electric power at the time the interval of 100 ms ends.

With respect to the heater lamp 64*a*, only during the time period of 100 ms from the start of the first power supply after switching from the first power control mode to the second power control mode, the heater lamp 64*a* is subjected to slow-up control.

With this arrangement, the amount of rush current to be generated can be reduced as compared with the case of such burst driving as to supply current of a value determined from the setting value of electric power immediately after the start of current supply, thus making it possible to lower the total sum of peak powers supplied to the heater lamps 64*a* to 64*c* upon generation of rush current. Thus, large power fluctuations and increase in noise, which would otherwise occur if the heater lamps 64*a* to 64*c* start being controlled at the same time, can be reduced, whereby the occurrence of shortage in the power required for burst driving in the second power control mode can be suppressed more effectively.

The slow-up control is not limited to include the first and second steps as described above as long as plural steps are included. Desirable arrangements include, in addition to the above-described arrangement, an arrangement wherein the power to be supplied to each of the plural heater lamps is as large as 10 to 25% of the setting value of electric power in the first step, as large as 40 to 65% of the setting value of electric power in the second step and as large as 70 to 90% of the setting value of electric power in the third step and then reaches the setting value of electric power at the time the time interval of 100 ms ends.

Slow-up control based on the aforementioned values made it possible to effectively suppress power fluctuations which were essential to the power supply in each step.

It should be noted that the aforementioned values used in respective steps were determined based on the result of examination in which a power source of 50 Hz frequency was used as shown in FIG. 21, the result of examination in which a power source of 60 Hz frequency was used similarly to the case of FIG. 21, the rated power values of the heater lamps 64, and errors.

FIG. 21 shows results of examination on characteristics in peak current, noise and voltage drop according to the present embodiment using a power source of 50 Hz frequency which were obtained when the power control operation consisted of a single step, i.e., no slow-up control was performed, when the slow-up control was performed in two steps and when the slow-up control performed in three steps.

As shown in FIG. 21, when the power control operation was performed in a single step in which a power of the setting value is supplied from the start of power supply, all the three characteristics were problematic (judged to be bad). In contrast, when the power control operation was performed in two or three steps, it was possible to lower a peak current and enhance the effect of suppressing noise and voltage drop by supplying a power of a suitable value in each step and a power of the setting value finally. Also, with such a lowered peak current and a reduced voltage drop, the heating efficiency of each heater lamp is improved, which can prevent the life of each heater lamp from being shortened.

As shown in FIG. 21, the most suitable two-step arrangement is an arrangement wherein: a power as large as 20% of the setting value of electric power is supplied in the first step; a power as large as 80% of the setting value of electric power is supplied in the second step; and a power of the setting value is supplied finally. The most suitable three-step arrangement is an arrangement wherein: a power as large as 20% of the setting value of electric power is supplied in the first step; a power as large as 50% of the setting value of electric power is supplied in the second step; a power as large as 80% of the setting value of electric power is supplied in the third step; and a power of the setting value is supplied finally.

Under conditions other than noted above, any one of the peak current, noise and voltage drop characteristics becomes problematic. For this reason, the combination of the above-noted optimum values is the best combination.

Figure 16A:
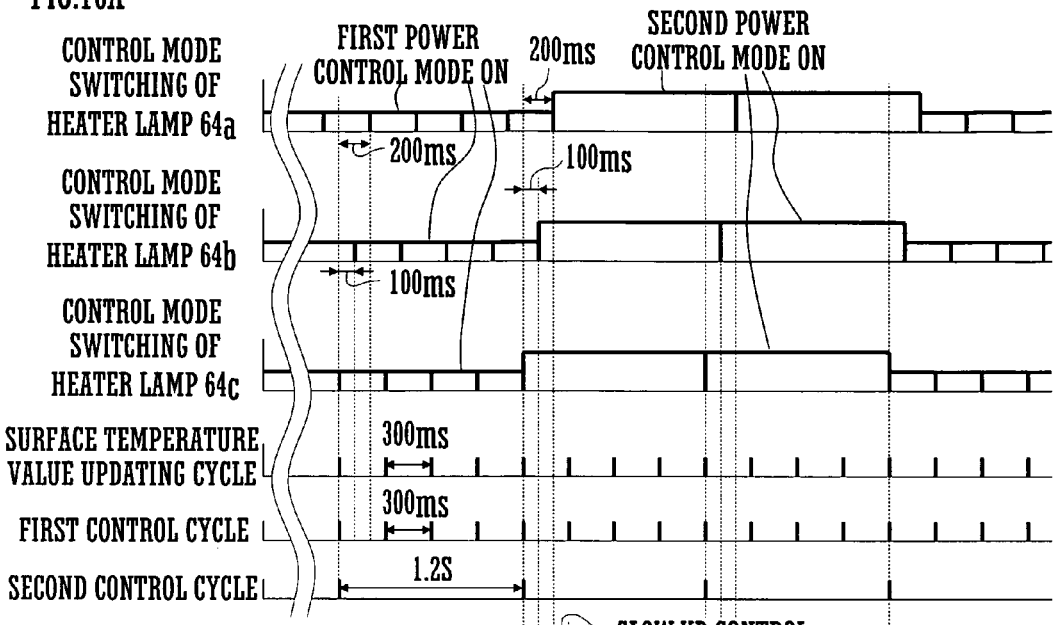
FIG. 16 is a timing chart of power control over heater lamps of the fixing device.
Figure 16B:
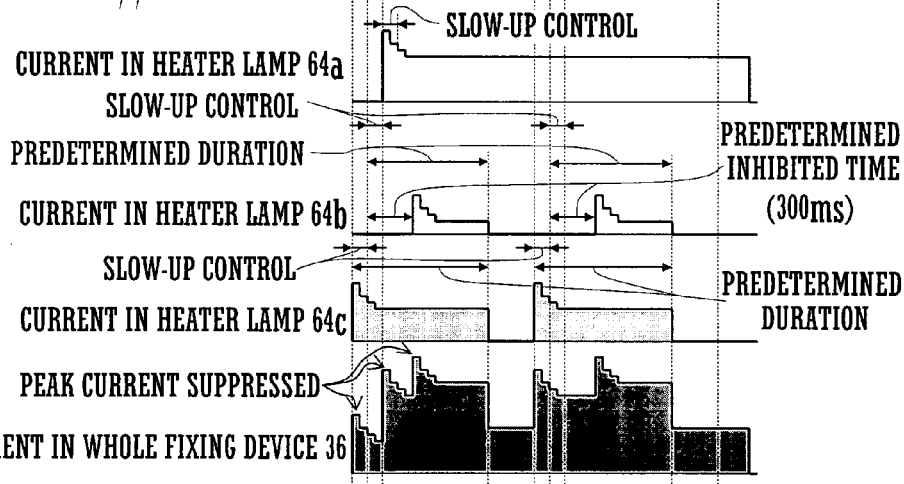

Further, the present embodiment is configured to inhibit supply of power (current in this embodiment) to the heater lamp 64*b* in the second power control mode until a predetermined inhibited time of 300 ms has passed from the start of the predetermined duration, as shown in FIG. 16(B). Thus, it is possible to more effectively prevent the total peak power supplied to the plural heater lamps 64*a* to 64*c* from rising upon generation of rush current as well as to minimize the decrease in the effect of power supply in the second power control mode.

Figure 16C:
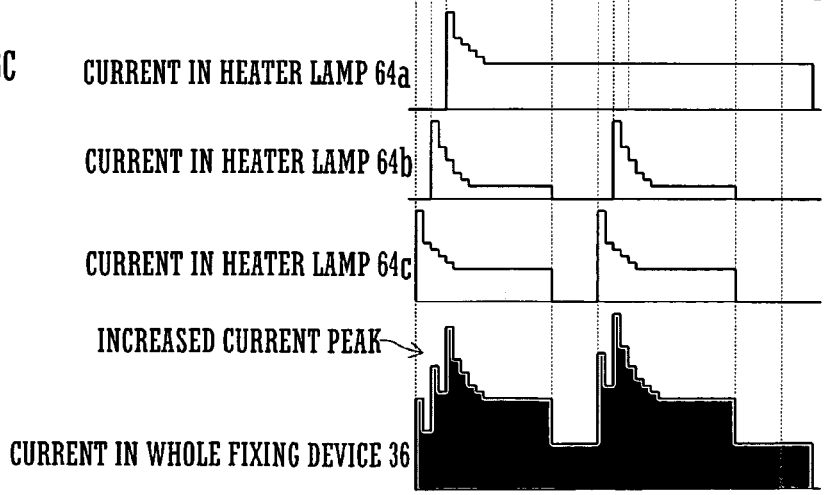

This arrangement is effective because, since rush current generated during burst driving of the heater lamps 64*a* to 64*c* in the second power control mode is very large as shown in FIG. 16(C) unless power supply is inhibited during the predetermined inhibited time, it is possible that the arrangement configured to stagger the second power control mode start timings for the heater lamps 64*b* and 64*c* by only 100 ms causes next burst driving of the heater lamp 64*b* or 64*c* to start before the power supplied lowers to reach the setting value of electric power completely after the generation of rush current and, at that moment, the total peak power supplied to the heater lamps 64*a* to 64*c* rises undesirably.

Though the predetermined inhibited time is set to 300 ms in the present embodiment, there is no particular limitation thereto as long as the inhibited time is a time period in which the total peak power of the heater lamps 64*a* to 64*c* can be suppressed to a desired level. However, care should be taken not to provide too long an inhibited time because such a long inhibited time nullifies the effect of power supply in the second power control mode.

In the present embodiment, the slow-up control is performed to suppress the increase in the total peak power of the heater lamps 64*a* to 64*c*. However, the duration of the slow-up control cannot be set very long because the slow-up control taking such a long time causes little power to be supplied in the second power control mode. Accordingly, inhibition to supply power for the predetermined inhibited time is very effective particularly where the slow-up control cannot suppress the total peak power supplied to the heater lamps 64*a* to 64*c* to a desired level.

Further, the present embodiment performs a control to correct the target temperature. In the present embodiment, the target surface temperature of the heating roller 61 is 185° C. but is set (corrected) to 210° C. during the warm-up operation immediately after the start of the printing operation and to 195° C. during a time period from the start of passage of recording sheets until a predetermined number of recording sheets, or 25 recording sheets have passed through the fixing device.

This arrangement is capable of increasing the power to be supplied to the heater lamps 64*a* to 64*c* temporarily, thereby making it possible to raise the surface temperature of the heating roller 61 more quickly. The predetermined number of recording sheets is not limited to 25. Correction may be made for a predetermined correction time from the start of printing without counting the predetermined number of recording sheets.

Here, the target temperature is varied for use during printing on the predetermined number of recording sheets or for use for the predetermined correction time from the start of the printing operation because it is desired to allow the surface temperature of the heating member to reach the target temperature and stabilize as quickly as possible and because it is difficult to supply an increased power to the heating means with the target temperature kept high for a long time.

There may be a case where the amount of rush current decreases due to the total peak power of the heater lamps 64*a* to 64*c* suppressed in the second power control mode and, hence, the amount of power supply to the heater lamp 64*b* in the second power control mode decreases, so that the surface temperature of the heating roller 61 does not rise quickly. For this reason, the arrangement configured to correct the target temperature according to the present embodiment is effective in raising the setting value of electric power to be supplied to the heater lamps 64*a* to 64*c* in the second power control mode.

Figure 17:
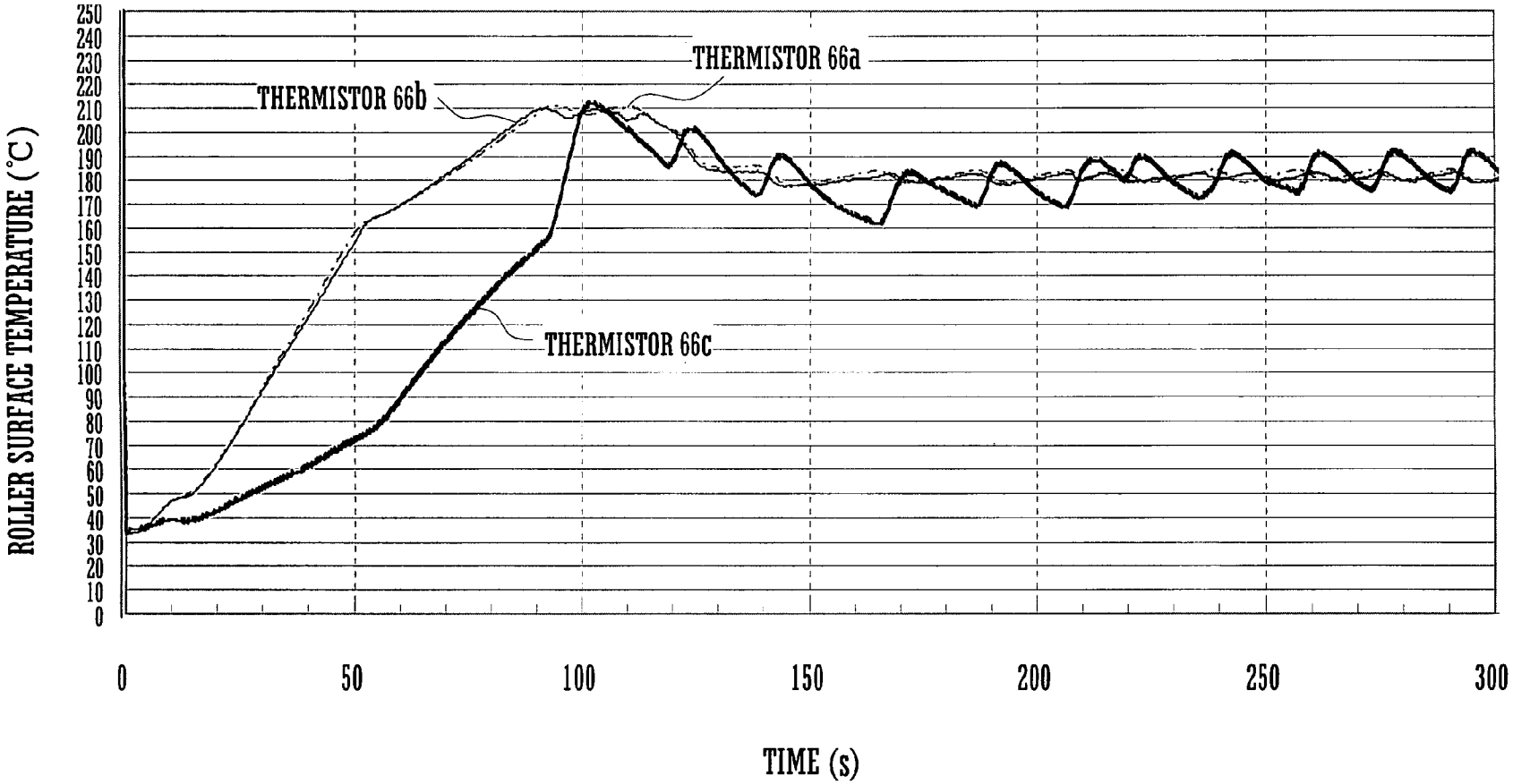
FIG. 17 is a chart showing changes in the surface temperatures of respective of a heating roller and an external heating roller included in the fixing device during a printing operation.

These arrangements are capable of properly maintaining the surface temperature of the heating roller 61 as shown in FIG. 17 while effectively suppressing the total peak power of the heater lamps 64*a* to 64*c*. FIG. 17 is a chart showing changes in the surface temperatures of respective of the heating roller 61 and the external heating roller 63 during printing on 200 recording sheets at a printing speed of 62 sheets per minute by the image forming apparatus 100 according to the present embodiment.

While the present embodiment uses the three rollers 61 to 63 and the three heater lamps 64*a* to 64*c*, there is no particular limitation to this arrangement. An arrangement using two rollers and one halogen lamp or a like arrangement is possible. Further, the fixing member (heating roller 61) or the pressure member (pressurizing roller 62) may be in the form of belt.

Embodiment 7

Figure 18:
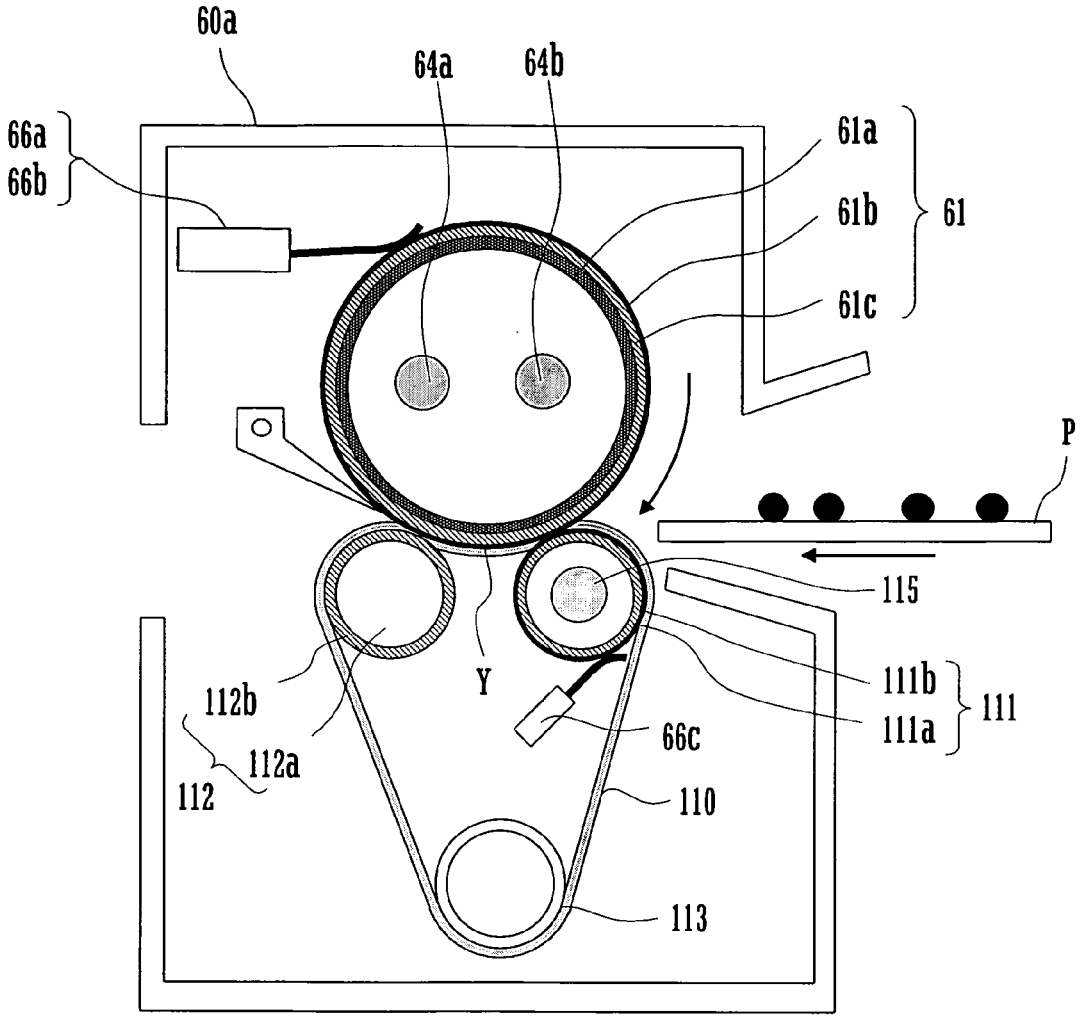
FIG. 18 is a sectional view schematically showing the construction of the fixing device.

This embodiment is substantially similar in construction to embodiment 6, but uses a pressurizing belt 110 as the pressure member instead of the pressurizing roller, as shown in FIG. 18. The construction of the heating roller 61 is modified to accommodate to the use of pressurizing belt 110.

The heating roller 61 has an outer diameter of 50 mm and comprises three layers including a core 61*a*, a rubber layer 61*c* and a release layer 61*b*. The core 61*a* is formed from an aluminum alloy like the cores described earlier and has a wall thickness of 1.5 mm on average. The rubber layer 61*c* comprises 1 mm-thick silicone rubber covering the outer periphery of the core 61*a*. The release layer 61*b* comprises a fluororesin tube (PFA tube) covering the outer periphery of the rubber layer 61*c*. The heater lamp 61 incorporates therewithin heater lamps 64*a* and 64*b* which are each substantially similar in construction as in embodiment 6 but have rated powers of 820 W and 450 W, respectively, in this embodiment.

The pressurizing belt 110 comprises a polyimide base having a width of 335 mm, an outer circumference ϕ of 60 mm and a thickness of 100 μm, and a release layer comprising a coat of fluororesin (PFA in this embodiment) covering the outer peripheral surface of the base.

Figure 19:
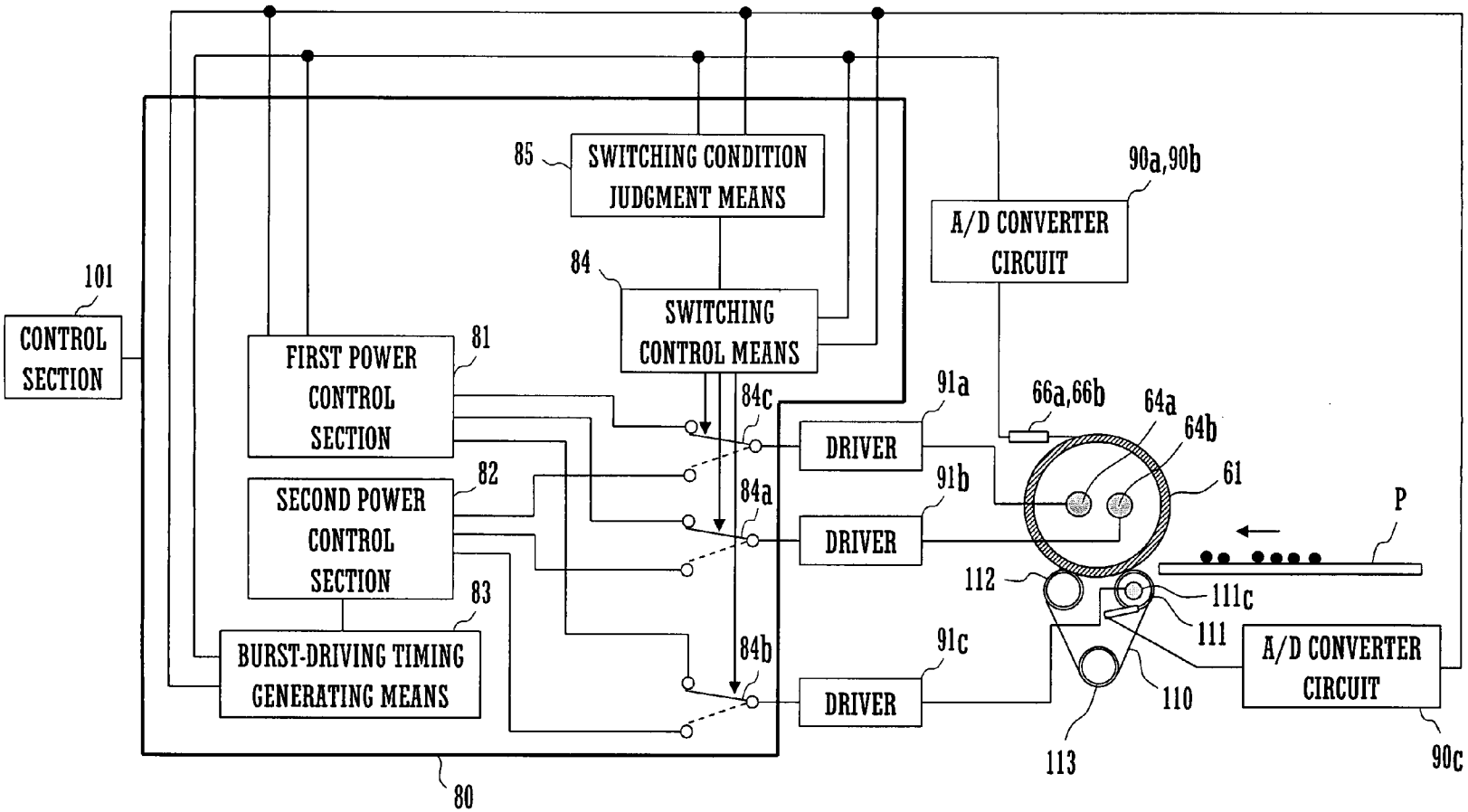
FIG. 19 is a block diagram showing the configuration of a power control section included in the fixing device.

The pressurizing belt 110 is entrained about a pressurizing and heating roller 111, a driving roller 112 and a tension roller 113 as shown in FIG. 19 and pressed against a portion of the outer periphery of the heating roller 61 to define a wide nip area Y where toner is fused and fixed to recording sheet P.

The pressurizing and heating roller 111 is substantially similar in construction to the external heating roller 63 of embodiment 6 but has an outer diameter of 20 mm and a wall thickness of 1 mm. Like the external heating roller 63, the pressurizing and heating roller 111 incorporates therein a heater lamp 115 (300 W in this embodiment) and located upstream of the nip area Y in the sheet feed direction indicated by arrow to heat the pressurizing belt 110 thereby facilitating fusion of toner for improving the fixing performance. The heater lamp 115 is connected only to the first power control section 81 via driver 91*d* so as to be power-controlled. Unlike embodiment 6, the present embodiment is configured to power-control only the heater lamps 64*a* and 64*b* in the first and second power control modes.

The driving roller 112 (having an outer diameter of 20 mm) rotates the pressurizing belt 110 at a lower rotational speed than the heating roller 61 by about 2 to 10% to provide a circumferential velocity difference between the heating roller 61 and the pressurizing belt 110. The driving roller 112 comprises a core 112*a* and a heat-resistance rubber layer 112*b* (having a thickness of 1 mm) of, for example, silicone rubber which coats the outer periphery of the core 112*a* for efficient transmission of driving force.

The tension roller 113 provides the pressurizing belt 110 with a tension of 20 N to prevent the pressurizing belt 110 from slackening thereby allowing the pressurizing belt 110 to revolve smoothly.

Though the present embodiment uses the pressurizing and heating roller 111 incorporating the heater lamp 115 therein, the driving roller 112 also may incorporate a heater lamp therein. The pressurizing and heating roller 111 need not necessarily incorporate the heater lamp 115 therein. Alternatively, it is possible to employ an external heating member for heating the outer peripheries of the heating roller 61 and pressurizing belt 110.

Figures 20A, 20B:
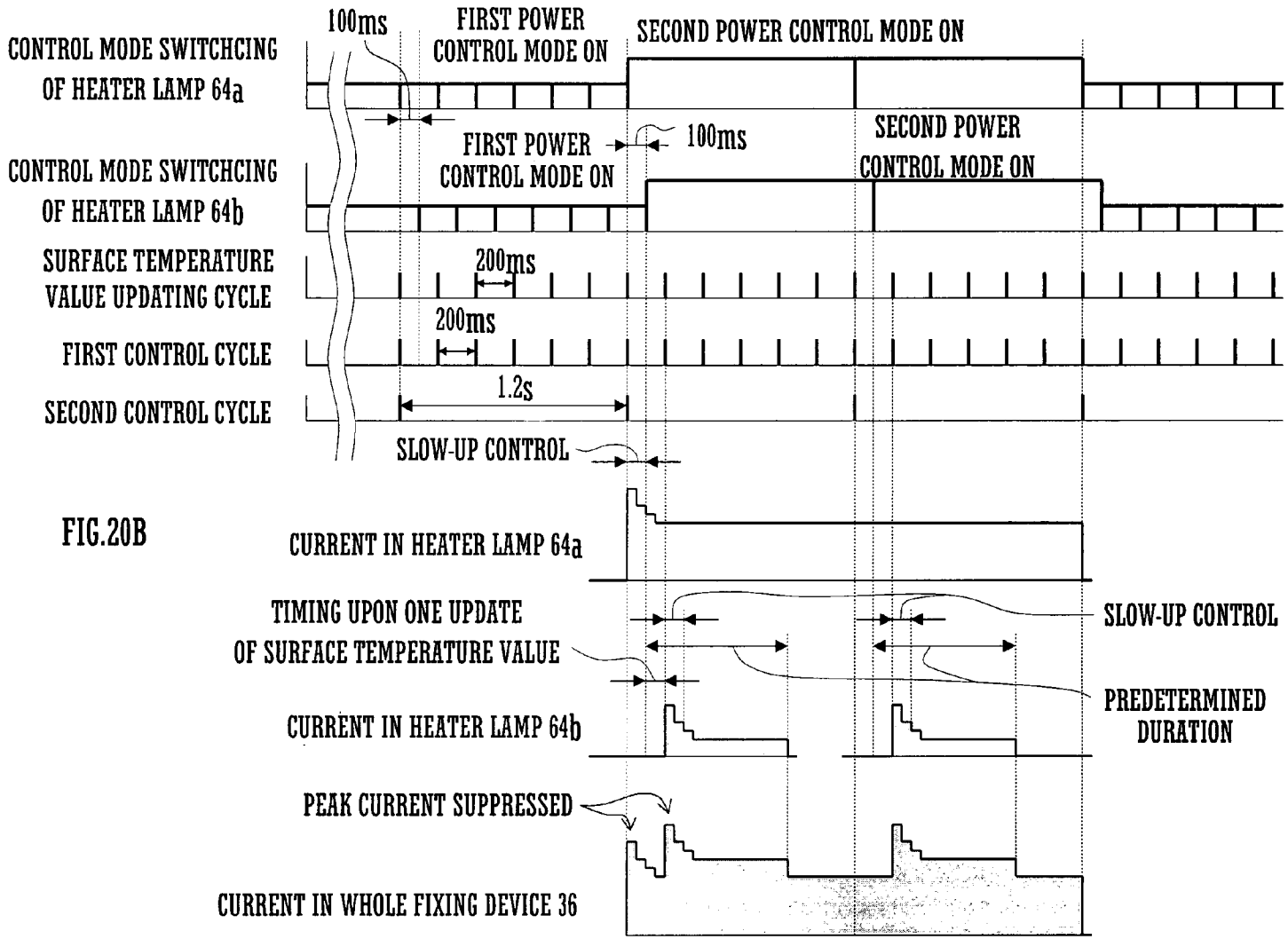
FIG. 20 is a timing chart of power control over heater lamps of the fixing device.

FIG. 20 is a timing chart of power control over the heater lamps 64*a* and 64*b* according to the present embodiment. As shown in FIG. 20(A), the first control cycle of the first power control mode is 200 ms and control start timing for the heater lamp 64*b* in each control mode is staggered by 100 ms from that for the heater lamp 64*a* serving as a reference. Note that FIG. 20 is a timing chart with the heater lamp 115 not operating.

With this arrangement, the heater lamps 64*a* and 64*b* start being controlled within the time period of one first control cycle, thus exercising the same effect as in embodiment 6.

The heater lamp 115 is controlled by the first power control section 84 to operate only when the heater lamps 64*a* and 64*b* are off. When a non-illustrated low-temperature-environment detector connected to the first power control section 84 detects a condition where the image forming apparatus 100 is in a low-temperature environment, the heater lamp 115 is supplied with power with predetermined timing to serve an auxiliary purpose for enhancing the fixing performance such as for shortening the warm-up time.

In the present embodiment, the updating cycle for updating the value of surface temperature of the heating roller 61 is 200 ms and the setting value of electric power of the heater lamp 64*a* in the second power control mode is fixed to the rated power value thereof.

Further, like embodiment 6, the present embodiment is configured to inhibit supply of power (current in this embodiment) to the heater lamp 64*b* in the second power control mode from the start of the predetermined duration until the value of surface temperature of the heating roller 61 is updated once as shown in FIG. 20(B), thus preventing the total peak power to be supplied to the heater lamps 64*a* and 64*b* from increasing upon generation of rush current as in embodiment 6.

Though supply of power is inhibited until the value of surface temperature of the heating roller 61 is updated once according to the present embodiment, the number of times of update of the value of surface temperature of the heating roller 61 is selected from one to three depending upon the predetermined duration. For example, if the predetermined duration essential to the fixing device 36 is long, supply of power is inhibited until the value of surface temperature of the heating roller 61 is updated twice.

Here, the number of times of update is limited to one to three because, though the time required for updating the surface temperature of the heating roller 61 is shorter than the predetermined duration in the second power control mode, the duration of actual power supply in the second power control mode is extremely shortened unless the number of times of update is limited to one to three, thus resulting in the second power control mode exercising no effect.

If the time period of one updating cycle for updating the surface temperature of the heating roller 61 is 200 to 500 ms for example, the predetermined duration in the second mode is often set to one second or shorter under restrictions by the magnitude of rush current and the allowable power value. In such cases, if the number of times of update is set to 4 or more, the duration for which the heater lamp 64 is actually supplied with power during forced driving is too short with a large loss incurred. Accordingly, the second power control mode would have no importance.

By inhibiting one to three times of supply of electric power in accordance with the length of the predetermined forced-driving time, it becomes possible to suppress the adverse effect of rush current as well as to minimize the decrease in the effect of power supply in the second power control mode.

Like embodiment 6, the present embodiment performs a control to correct the target temperature. In the present embodiment, the target surface temperature of the heating roller 61 is usually 170° C. but is set to 175° C. from the start of the printing operation until a predetermined number of recording sheets, or 50 recording sheets have passed through the fixing device. This arrangement can exercise the same effect as in embodiment 6.

While embodiments 1 to 7 are each directed to the fixing device for use in a monochromatic image forming apparatus, there is no particular limitation thereto. The present invention is applicable to a color image forming apparatus 100.

While the fixing device according to any one of embodiments 1 to 7 uses heater lamps 64 and 115 as the heating means of the present invention, there is no particular limitation thereto. For example, heating means of the resistance heating type or the induction heating type may be used. Further, there is no particular limitation to the specific values used as the predetermined duration and temperatures in embodiments 1 to 7.

While the fixing device according to any one of embodiments 1 to 7 includes power control section 80 as the power control device of the present invention, there is no particular limitation thereto. The power control device may be used in any apparatus employing heating means such as a dryer for use in a copying machine or ink-jet printer, an electric heater, a microwave oven, or an air conditioner.

The invention claimed is:

1. A power control method for controlling an electric power to be supplied to a heating part including a single or plural heating units, the heating part heating a medium to be heated via a heating object, comprising:

switching between a first power control mode for controlling an electric power to be supplied to the heating part to a setting value of electric power based on the temperature of the heating object and a second power control mode for forced-driving the heating part by an electric power more than the setting value of electric power, depending on a status of operation of each of components of an apparatus including the heating part, wherein the first power control mode is switched to the second power control mode so that an electric power which is more than the setting value of electric power is supplied to the heating part, based on the occasion an electric power supplied to the apparatus is lower than a rated electric power of the apparatus due to a decrease in power consumption of each of the components of the apparatus, the forced driving is burst driving, the setting value of electric power to be supplied to the heating part during the burst driving is controlled depending on the status of operation of each of the components of the apparatus, the switching between the first power control mode and the second power control mode is synchronously performed with a second control cycle of the second power control mode which is longer than a first control cycle of the first power control mode, the heating part are subjected to forced driving during the second power control mode by being supplied with electric power for a predetermined duration per one second control cycle, the second control cycle is an integer times as long as the first control cycle, and an updating cycle for updating value of temperature of the heating object used during the first power control mode is an integer times as long as the first control cycle for the heating part.

2. The power control method according to claim 1, wherein within a time period of one updating cycle for updating the value, the control modes for the heating part start with different timings.

3. The power control method according to claim 2, wherein the different control mode start timings for the heating part occurs within a time period of one first control cycle.

4. The power control method according to claim 2, wherein supply of electric power to the heating part is inhibited from start of the second power control mode until a predetermined inhibited time has passed.

5. The power control method according to claim 2, wherein supply of electric power to the heating part is inhibited from start of the second power control mode until the value of temperature of the heating object is updated one to three times depending on the predetermined duration.

6. The power control method according to claim 3, wherein a value of electric power to be supplied to the heating part is increased gradually to the setting value of electric power in plural steps during a time period from a start of power supply in the second power control mode to a subsequent start of power supply in the second power control mode.

7. The power control method according to claim 6, wherein the plural steps include a first step of supplying the heating part with electric power of a value as large as 15 to 30% of the setting value of electric power and a second step of supplying the heating part with an electric power of a value as large as 65 to 85% of the setting value of electric power.

8. The power control method according to claim 6, wherein the plural steps include a first step of supplying the heating part with electric power of a value as large as 10 to 25% of the setting value of electric power, a second step of supplying the heating part with electric power of a value as large as 40 to 65% of the setting value of electric power, and a third step of supplying the heating part with electric power of a value as large as 70 to 90% of the setting value of electric power.

9. The power control method according to claim 1, wherein the second control cycle and the predetermined duration are controlled based on the setting value of electric power upon start of the second power control mode.

10. The power control method according to claim 1, wherein before switching between the first power control mode and the second power control mode, judgment is made as to whether or not to perform switching to the second power control mode based on conditions of variation in the temperature of the heating object or processing conditions for heating the medium to be heated.

11. The power control method according to claim 1, wherein the predetermined duration per one second control cycle is controlled based on conditions of variation in the temperature of the heating object or processing conditions for heating the medium to be heated in forced-driving the heating part in the second power control mode.

12. The power control method according to claim 1, wherein a heating unit to be switched to the second power control mode is selected from a plural heating parts based on conditions of variation in the temperature of the heating object or processing conditions for heating the medium to be heated.

13. The power control method according to claim 10, wherein the judgment as to whether or not to perform switching to the second power control mode is disabled from start of heating of the medium to be heated by the heating object until a fixed time period has passed or until the number of to-be-heated bodies having been heated exceeds a predetermined number.

14. The power control method according to claim 1, wherein in switching to the second power control mode, at least that a heating part of a plural heating parts which has the highest rated power value is not to be switched to the second power control mode.

15. The power control method according to claim 1, wherein the setting value of electric power to be supplied to the heating part during the first power control mode is selected from a first setting power value group consisting of plural predetermined setting power values for use in controlling the setting value of electric power in the first power control mode; and the setting value of electric power to be supplied to the heating part during the second power control mode is selected from a second setting power value group consisting of plural predetermined setting power values for use in controlling the setting value of electric power in the second power control mode.

16. The power control method according to claim 1, wherein the setting value of electric power to be supplied to an 'm'th (m=1, 2, . . . , n) one of n (n≧1) heating unit in the first power control mode is W1*m* (W); the setting value of electric power to be supplied to the 'm'th heating unit in the second power control mode is W2*m* (W); a second control cycle of the second power control is T1 (ms); a duration for which the 'm'th heating unit is to be supplied with electric power within one second control cycle is T2*m* (ms); a coefficient associated with switching of the 'm'th heating unit between the first power control mode and the second power control mode is K1*m*; and an increase in electric power resulting from the switching of the 'm'th heating unit between the control modes is ΔWm (W), W1*m*, W2*m*, T1, T2*m*, K1*m* and ΔWm satisfy the expression of relation:

$$\Delta Wm=(1/T1)\times\{(T1\times K1m-1)\times W1m+(W2m-W1m)\times T2m\times K1m\}.$$

17. The power control method according to claim 1, wherein the setting value of electric power to be supplied to the heating part in the second power control mode is a rated power value.

18. A power control device included in a main apparatus for controlling an electric power to be supplied to a heating part including a single or plural heating units, the heating part heating a medium to be heated via a heating object, and a fixing device included in the image forming apparatus and having a heating member to be heated by the heating part based on a detected temperature detected by temperature detection units and a pressure member positioned to press against a surface of the heating member, wherein during a printing operation of the image forming apparatus that follows completion of a warm-up operation caused by the detected temperature of the heating member reaching a temperature not lower than a target temperature, a medium to be heated is heated by being passed through a nip area defined between the heating member having the heating part therewithin and the pressure member, the main apparatus comprising:

a switching controller configured to perform switching between a first power control mode for controlling an electric power to be supplied to the heating part to a setting value of electric power based on the temperature of the heating object and a second power control mode for forced-driving the heating part by an electric power that is higher than the setting value of electric power, depending on a status of operation of each of components of a main apparatus including the heating part;

the power control device for use in controlling an setting value of electric power to be supplied to the heating part incorporated in the heating member;

a transmission member in contact with a surface of the pressure member, the transmission member including the heating part for heating a surface of the transmission member, and temperature detection unit for detecting the temperature of the transmission member; and a temperature detection unit for detecting the temperature of the pressure member, wherein the first power control mode is switched to the second power control mode so that an electric power which is more than the setting value of electric power is supplied to the heating part, based on the occasion an electric power supplied to the apparatus is lower than a rated electric power of the main apparatus due to a decrease in power consumption of each of the components of the main apparatus, the power control device is used to control the setting value of electric power to be supplied to the heating part included in the transmission member, the switching controller judges whether or not to perform switching of the heating part for heating the transmission member to the second power control mode based on the detected temperature of the pressure member detected by the temperature detection units, in the first power control mode the temperature of the pressure member is estimated from the temperature of the transmission member detected by the temperature detection unit and the judgment as to whether or not to perform switching of the heating part for heating the transmission member to the second power control mode is made based on the estimated temperature of the pressure member, and the switching controller causes the second power control mode to work from start of the printing operation immediately following the completion of the warm-up operation until a predetermined forced-driving time has passed.

19. The fixing device according to claim 18, wherein the heating part is subjected to forced driving during the second power control mode by being supplied with electric power for a predetermined duration per one second control cycle of the second power control mode, the second control cycle and the predetermined duration are varied and the second power control mode is caused to work as long as the detected temperature of the heating part is lower than a predetermined setting temperature which is lower than the target temperature before or immediately after passing of the predetermined forced-driving time.

20. The fixing device according to claim 18, wherein a rated power value of the heating part or a total rated power value which is the sum total of rated power values of a plurality of heating parts is W0 (W); the setting value of electric power of the heating part or a total setting value of electric power which is the sum total of setting values of electric power of the plurality of heating parts is W1 (W); a rated power value of the image forming apparatus is W2 (W); a driving power value of a control section controlling an operation of the image forming apparatus is W3 (W); a value of driving power to be used in driving a mechanical portion of the image forming apparatus is W4 (W); and a rated power value of an optional part to be disposed on the image forming apparatus is W5 (W), W0, W1, W2, W3, W4 and W5 satisfy the expressions of relation:

$$W1 \leqq W2-(W3+W4+W5); \text{ and}$$

$$W1 \leqq W0.$$

21. The fixing device according to claim 18, wherein the target temperature is corrected in the second power control mode during printing on a predetermined number of recording sheets or during a predetermined correction time from start of the printing operation.

* * * * *